US008027476B2

(12) United States Patent
Miura et al.

(10) Patent No.: US 8,027,476 B2
(45) Date of Patent: Sep. 27, 2011

(54) SOUND REPRODUCTION APPARATUS AND SOUND REPRODUCTION METHOD

(75) Inventors: Masayoshi Miura, Chiba (JP); Susumu Yabe, Tokyo (JP)

(73) Assignee: SONY Corporation, Tokyo (JP)

( * ) Notice: Subject to any disclaimer, the term of this patent is extended or adjusted under 35 U.S.C. 154(b) by 1221 days.

(21) Appl. No.: 11/049,911

(22) Filed: Feb. 3, 2005

(65) Prior Publication Data

US 2005/0190925 A1 Sep. 1, 2005

(30) Foreign Application Priority Data

Feb. 6, 2004 (JP) ..... 2004-030876

(51) Int. Cl.
*H04R 5/00* (2006.01)

(52) U.S. Cl. ..... 381/17; 381/1; 381/18; 381/19

(58) Field of Classification Search ..... 381/1, 17–23, 381/97–99

See application file for complete search history.

(56) References Cited

U.S. PATENT DOCUMENTS

| | | | | |
|---|---|---|---|---|
| 5,333,200 | A * | 7/1994 | Cooper et al. | 381/1 |
| 5,377,274 | A | 12/1994 | Meyer et al. | |
| 5,381,482 | A | 1/1995 | Matsumoto et al. | |
| 5,579,913 | A | 12/1996 | Yamada et al. | |
| 5,666,425 | A | 9/1997 | Sibbald et al. | |
| 5,696,831 | A | 12/1997 | Inanaga et al. | |
| 5,751,815 | A * | 5/1998 | Philp et al. | 381/17 |
| 5,757,931 | A | 5/1998 | Yamada et al. | |
| 5,841,879 | A | 11/1998 | Scofield et al. | |
| 7,152,082 | B2 * | 12/2006 | McGrath | 708/300 |
| 7,167,567 | B1 * | 1/2007 | Sibbald et al. | 381/17 |
| 2006/0098827 | A1 | 5/2006 | Paddock et al. | |

FOREIGN PATENT DOCUMENTS

| | | |
|---|---|---|
| EP | 0 553 832 A1 | 8/1993 |
| JP | 57-39113 | 8/1982 |
| JP | 61-21192 | 7/1986 |
| JP | 62-005713 | 1/1987 |
| JP | 04-284100 A | 10/1992 |
| JP | 04-364700 | 12/1992 |
| JP | 05-030600 | 2/1993 |
| JP | 05-115098 | 5/1993 |

(Continued)

OTHER PUBLICATIONS

Pierre L. Divenyi, "Binuaural Suppression of Nonechoes", J. Acoust. Soc. Am., vol. 91, No. 2, 1992, pp. 1078-1084.

(Continued)

*Primary Examiner* — Devona E Faulk
(74) *Attorney, Agent, or Firm* — Finnegan, Henderson, Farabow, Garrett & Dunner LLP

(57) ABSTRACT

A sound reproduction apparatus capable of providing a target sensation of sound localization to a listener by using a standard head-related transfer function is provided. In a microphone amplifying section, only the high frequency components of a left sound pickup signal and a right sound pickup signal, which are input from a dummy head microphone, are delayed by a delay circuit. Consequently, since the reproduction sound of the low frequency components having small individual differences can be output earlier, a listener in a reproduction sound field space can perceive the sensation of sound localization by the reproduction sound of the low frequency components that arrive earlier. As a result, even when a standard head-related transfer function is used, it becomes possible to enable the listener in the reproduction sound field space to perceive the target sensation of sound localization.

14 Claims, 21 Drawing Sheets

FOREIGN PATENT DOCUMENTS

| | | |
|---|---|---|
| JP | 06-165298 | 6/1994 |
| JP | 06-217400 | 8/1994 |
| JP | 07-107598 | 4/1995 |
| JP | 08-182100 | 7/1996 |
| JP | 08-507910 | 8/1996 |
| JP | 9-163346 | 6/1997 |
| JP | 09-327099 | 12/1997 |
| JP | 10-070798 | 3/1998 |
| JP | 10-75219 | 3/1998 |
| JP | 10-164447 | 6/1998 |
| JP | 10-320413 | 12/1998 |
| JP | 11-88280 | 3/1999 |
| JP | 03-095201 | 10/2000 |
| JP | 2000-333297 | 11/2000 |
| JP | 2001-346298 | 12/2001 |
| JP | 2001-165300 | 6/2002 |
| JP | 03-095201 | 4/2003 |
| JP | 2005-529520 | 9/2005 |
| WO | WO 95/34883 | 12/1995 |
| WO | WO 97/25834 | 7/1997 |
| WO | WO 03/104924 | 12/2003 |

OTHER PUBLICATIONS

Begault, D. et al., "Technical Aspects of a Demonstration Tape for Three-Dimensional Sound Displays," NASA Technical Memorandum, vol. TM-102826, Oct. 1990, 8 pages.

Litovsky, R. et al., "The Precedence Effect," Journal of the Acoustical Society of America, vol. 106, No. 4, Oct. 1999, pp. 1633-1654.

An Office Action dated Nov. 26, 2008 in U.S. Appl. No. 11/049,810, 10 pages.

A Notification of Reasons for Refusal issued in a related Japanese patent application dated Mar. 8, 2007, 5 pages.

Office Action issued by Japanese Patent Office in counterpart Japanese Application No. 2004-30876 dated Jan. 26, 2010 (5 pages).

*Transactions of the Virtual Reality Society of Japan*, The Virtual Reality Society of Japan (TVRSJ), vol. 5, No. 3, 2000 (pp. 981-988).

Office Action in copending U.S. Appl. No. 11/049,810 mailed Sep. 1, 2009 (8 pages).

Office Action in copending U.S. Appl. No. 11/049,810 mailed May 5, 2009 (11 pages).

Office Action in copending U.S. Appl. No. 11/049,810 mailed Nov. 26, 2008 (11 pages).

* cited by examiner

ACTUAL SOUND FIELD

FIG. 11A

| SOUND SOURCE DIRECTION θLf FOR LEFT EAR | TRANSFER FUNCTION FOR LEFT EAR | SOUND SOURCE DIRECTION θRf FOR RIGHT EAR | TRANSFER FUNCTION FOR RIGHT EAR |
|---|---|---|---|
| 0° (FRONT) | HL0 | 0° (FRONT) | HR0f |
| LEFT 5° | HL5f | LEFT 5° | HR5f |
| LEFT 10° | HL10f | LEFT 10° | HR10f |
| ····· | ····· | ····· | ····· |
| LEFT 180° | HL180f | LEFT 180° | HR180f |
| LEFT 185° | HL185f | LEFT 185° | HR185f |
| LEFT 190° | HL190f | LEFT 190° | HR190f |
| ····· | ····· | ····· | ····· |
| LEFT 355° | HL355f | LEFT 355° | HR355f |

FIG. 11B

| SOUND SOURCE DIRECTION θLn FOR LEFT EAR | TRANSFER FUNCTION FOR LEFT EAR | SOUND SOURCE DIRECTION θRn FOR RIGHT EAR | TRANSFER FUNCTION FOR RIGHT EAR |
|---|---|---|---|
| 0° (FRONT) | HL0 | 0° (FRONT) | HR0n |
| LEFT 5° | HL5n | LEFT 5° | HR5n |
| LEFT 10° | HL10n | LEFT 10° | HR10n |
| ····· | ····· | ····· | ····· |
| LEFT 180° | HL180n | LEFT 180° | HR180n |
| LEFT 185° | HL185n | LEFT 185° | HR185n |
| LEFT 190° | HL190n | LEFT 190° | HR190n |
| ····· | ····· | ····· | ····· |
| LEFT 355° | HL355n | LEFT 355° | HR355n |

FIG. 14A

| SOUND SOURCE DIRECTION θ | TRANSFER FUNCTION FOR LEFT EAR | TRANSFER FUNCTION FOR RIGHT EAR |
|---|---|---|
| 0° (FRONT) | HL0f | HR0f |
| LEFT 5° | HL5f | HR5f |
| LEFT 10° | HL10f | HR10f |
| ····· | ····· | ····· |
| LEFT 180° | HL180f | HR180f |
| LEFT 185° | HL185f | HR185f |
| LEFT 190° | HL190f | HR190f |
| ····· | ····· | ····· |
| LEFT 355° | HL355f | HR355f |

FIG. 14B

| SOUND SOURCE DIRECTION θ | TRANSFER FUNCTION FOR LEFT EAR | TRANSFER FUNCTION FOR RIGHT EAR |
|---|---|---|
| 0° (FRONT) | HL0n | HR0n |
| LEFT 5° | HL5n | HR5n |
| LEFT 10° | HL10n | HR10n |
| ····· | ····· | ····· |
| LEFT 180° | HL180n | HR180n |
| LEFT 185° | HL185n | HR185n |
| LEFT 190° | HL190n | HR190n |
| ····· | ····· | ····· |
| LEFT 355° | HL355n | HR355n |

SOUND REPRODUCTION APPARATUS AND SOUND REPRODUCTION METHOD

BACKGROUND OF THE INVENTION

1. Field of the Invention

The present invention relates to a sound reproduction apparatus capable of three-dimensional stereophonic sound reproduction and a sound reproduction method for use with the sound reproduction apparatus.

2. Description of the Related Art

Hitherto, as a sound field reproduction system for reproducing a three-dimensional stereophonic sound field, for example, a sound system for reproducing three-dimensional stereophonic sound using two speakers in front of and two speakers behind a listener, that is, a total of four speakers, is known. In addition to the sound reproduction system described above, a three-dimensional sound reproduction system for reproducing a three-dimensional stereophonic sound field using two speakers has also been proposed.

When the sound reception of a concert hall is reproduced in a listening room by using a sound reproduction system for reproducing a stereophonic sound field by using two speakers, a sound signal that is radiated from a sound source, such as a musical instrument, and that arrives at the ears of the audience accompanied with the reverberations of the hall is necessary. It is known that such a sound signal is obtained by picking up sound by using a dummy head microphone such that microphones are mounted at the positions of two ears of a dummy head based on the shape of the head of a human being, that is, by binaural sound pickup.

Examples of binaural sound pickup include a method in which a sound signal that arrives at the ears of the audience is directly picked up by arranging a dummy head microphone in a seat of a concert hall, and a method in which sound is picked up by electrically superposing propagation characteristics from the position of the sound source, which are determined by measurements or simulation, to the ears of a listener onto a signal of a sound source such as a musical instrument (see Japanese Unexamined Patent Application Publication No. 5-115098). In the former case of the sound pickup method for directly picking up sound, the propagation characteristics from the position of the sound source to the ears of the listener are acoustically superposed onto the sound from the sound source.

However, in these sound reproduction systems, since propagation characteristics from the position of the speaker disposed in the listening room to the position of the listener are not necessary, a filter for canceling such propagation characteristics needs to be provided.

In order to transmit the sound to the tympanic membrane, which is recorded by the dummy head microphone, to the tympanic membrane of the listener by using a speaker, as a technology for canceling propagation characteristics from the playback speaker to the listener, technologies, such as TRADIS (True Reproduction of All Directional Information by Stereophony) and OSS (Ortho-Stereophonic System), have been developed. Also, a technology in which a technique for inserting indoor propagation characteristics of a performance as given in a concert hall is combined with the above has been proposed (see Japanese Unexamined Patent Application Publication No. 10-70798).

Japanese Unexamined Patent Application Publication No. 5-30600 discloses a method in which a frequency band that is effective for sound image control is separated by a filter, and sound image control is performed on a signal of the frequency band, so that the amount of computation is reduced. Japanese Unexamined Patent Application Publication No. 7-107598 discloses a method in which signal processing is performed by increasing the number of band divisions, and a sound image having natural expansion is reproduced.

A head-related transfer function, which indicates propagation characteristics from the position of the sound source to the ears of the listener in the binaural sound pickup described above, is also called a head diffraction transfer function, and the propagation characteristics are measured by using the sound source direction (angle) as a parameter.

However, since such a head-related transfer function depends on the head shape and the pinna shape, it differs for each listener. In particular, since the characteristics of the high frequency band have large individual differences, a head-related transfer function that applies to many persons cannot be realized over a wide band.

In order to improve the quality of the reproduction sound image when a sound signal picked up by binaural sound pickup is reproduced, theoretically speaking, it is necessary to optimize the sound pickup device for each listener. More specifically, since the head-related transfer function needs to be measured for each listener and optimized, a sound pickup device that is commercially practical for the general public cannot be constructed.

Accordingly, in order for the head-related transfer function to apply to many listeners, it is considered that superposition is performed by permitting a certain degree of error in order to generalize the head-related transfer function. However, if the head-related transfer function is generalized over a wide band, there is a risk of the sound localization of the stereophonic sound becoming unstable, and the sound image that should originally be perceived as a front sound image is mistakenly perceived as a back sound image, that is, so-called reverse front/back mis-perception occurs.

Variations in the head-related transfer function described above occur due to variations of the head shape and the pinna shape of the listener and due to the relationship with the wavelength of sound waves that arrive from the sound source. For this reason, variations in the head-related transfer function for each listener are small for the low frequency components and are large for the high frequency components.

Therefore, if, during sound pickup, an upper limit is provided for the sound band in which sound is picked up and the sound pickup is performed by targeting only the low frequencies, the head-related transfer function can be generalized. However, in that case, there is a drawback in that an unnatural sound having no high frequency components is generated.

As described above, in the conventional binaural sound pickup, since a head-related transfer function is difficult to generalize (standardize), it is not possible to provide a target sensation of sound localization with a natural sound to a large number of listeners.

The problems, described up to this point, resulting from the individual differences of propagation characteristics from the sound source to the ears of the listener affect not only the reproduction of the above-described propagation characteristics from the position of the sound source to the ears of the listener in the original sound field, but also a canceling filter for canceling propagation characteristics from the playback speaker to the ears of the listener in a listening room.

More specifically, since the characteristics of the canceling filter depend on the propagation characteristics of the listener, strictly speaking, it is necessary to design a canceling filter for each listener. The characteristics of such a canceling filter can also be generalized. However, since an error becomes larger particularly in the high frequency band, there are drawbacks in that the canceling effect is small, and the perception of the sound image direction becomes unstable.

SUMMARY OF THE INVENTION

Accordingly, the present invention has been made in view of the above-described points. An object of the present invention is to provide a sound reproduction apparatus and a sound reproduction method capable of providing a target sensation of sound localization to listeners by using a standard head-related transfer function.

To achieve the above-mentioned object, in one aspect, the present invention provides a sound reproduction apparatus for reproducing a stereophonic sound by using two speakers, the sound reproduction apparatus including: separation means for separating low frequency components from a binaural sound pickup signal; delay means for delaying at least high frequency components of the binaural sound pickup signal; and stereophonic sound signal generation means for generating, based on a transfer function from the two speakers to a listening position, a stereophonic sound reproduction signal by performing predetermined signal processing on a signal output from the separation means and a signal output from the delay means.

In another aspect, the present invention provides a sound reproduction apparatus for reproducing a stereophonic sound by using two speakers, the sound reproduction apparatus including: separation means for separating low frequency components from an input signal; delay means for delaying at least high frequency components of the input signal; and stereophonic sound signal generation means for generating, based on a transfer function from the two speakers to a listening position, a stereophonic sound reproduction signal by performing predetermined signal processing on at least a signal of the low frequency components contained in the input signal.

In another aspect, the present invention provides a sound reproduction method for reproducing a stereophonic sound by using two speakers, the sound reproduction method including: a step of separating low frequency components from an input signal; a step of delaying at least high frequency components of the input signal; and a step of reproducing, based on a transfer function from the two speakers to a listening position, a stereophonic sound at the listening position by performing predetermined signal processing on the separated low frequency components and the delayed input signal.

According to the present invention described above, since high frequency components of an input signal or a binaural sound pickup signal are delayed, it is possible to reproduce a sound signal in which the low frequency components of the input signal or the binaural sound pickup signal come first in time.

In the manner described above, according to the present invention, a sound signal in which the low frequency components of the input signal or the binaural sound pickup signal come first in time can be reproduced. Therefore, even when stereophonic sound characteristics are generated by using a standard head-related transfer function, it is possible to enable the listener in the reproduction sound field to perceive a target sound image and it is possible to reproduce a more natural, rich stereophonic sound.

BRIEF DESCRIPTION OF THE DRAWINGS

FIGS. 11A and 11B show correspondence data tables of head diffraction transfer functions;

FIGS. 14A and 14B show correspondence data tables of head diffraction transfer functions;

DETAILED DESCRIPTION OF THE PREFERRED EMBODIMENTS

A sound apparatus according to an embodiment of the present invention will now be described below. Before the sound apparatus according to this embodiment is described, the relationship between physical sound information and sound phenomena perceived subjectively by a listener, and properties of the sense of hearing regarding sound image perception of a human being are described.

First, a description will be given, with reference to FIGS. 1A and 1B and FIG. 2, of the relationship between physical sound information (sound field information) and sound phenomena (perception of the sound image position, etc.) perceived subjectively by a listener.

Figure 1A:
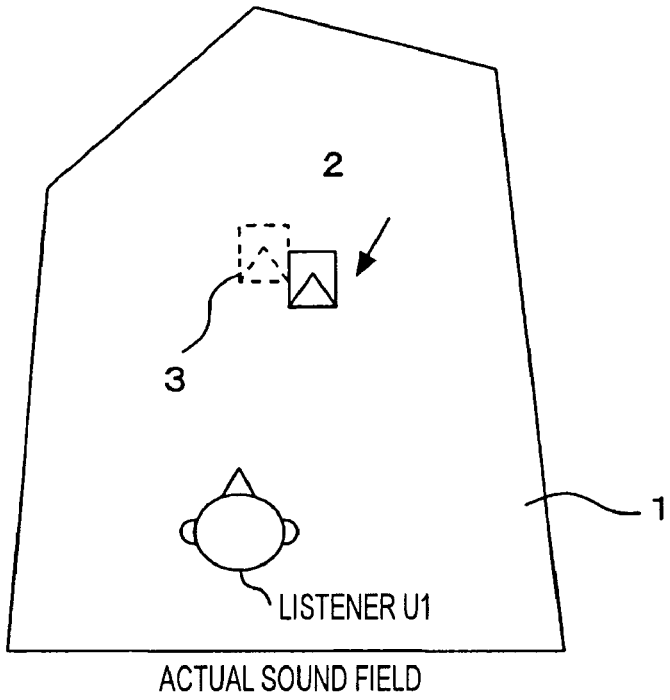
FIGS. 1A and 1B are illustrations showing the relationship between the position of a sound source and the position of a sound image perceived by a listener in a sound field space.
Figure 1B:
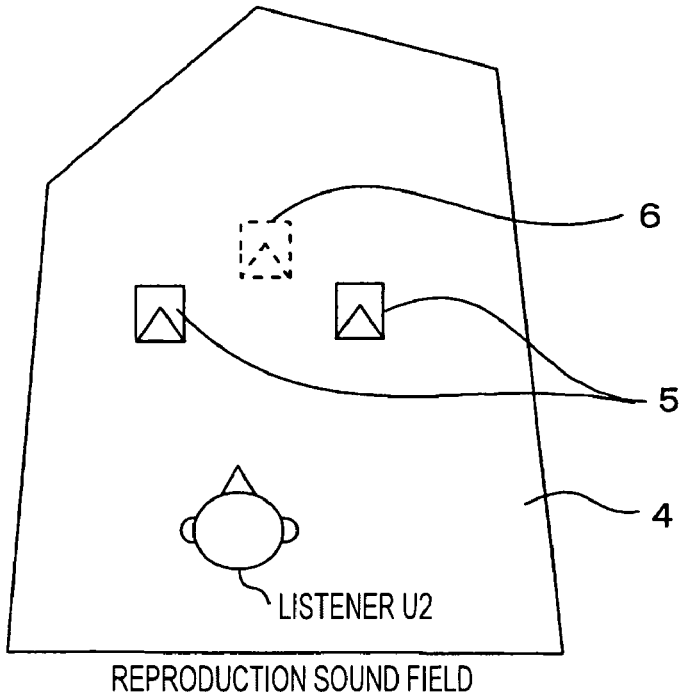

FIGS. 1A and 1B are illustrations showing the relationship between the position of a sound source and the position of a sound image perceived by a listener in a sound field space. FIG. 1A shows the relationship between the position of a sound source and the position of a perceptual sound image perceived by a listener in an actual sound field. FIG. 1B shows the relationship between the playback position and the position of a perceptual sound image perceived by a listener in a reproduction sound field.

In general, when there is a sound source in a sound field space regardless of the actual sound field and the reproduction sound field, often, the perceptual sound image position perceived by the listener differs from the physical sound image position. For example, when an actual sound source 2 is arranged in an actual sound field space 1 shown in FIG. 1A, there are cases in which the position of a perceptual sound image 3 perceived by a listener U1 differs from the position of the actual sound source 2.

When two playback speakers 5 and 5 are arranged as the reproduction sound source in a reproduction sound field space 4 shown in FIG. 1B, there are cases in which a perceptual sound image 6 is perceived by a listener U2 at the position indicated by the broken line.

This can be attributed to the fact that a physical clue for a listener to perceive the sound image position in a sound field space is sound obtained at the two ears of the listener (binaural sound) and that the boundary connecting together the acoustic physical space and the subjective psychological space is sound signals at the two ears. Therefore, if, by using some kind of means, sound, shown in FIG. 1A, which is the same as that heard by the listener U1 in the actual sound field, can be reproduced in a reproduction sound field shown in FIG. 1B, it is considered that the listener U2 in the reproduction sound field can perceive the same sound image as that in the actual sound field. With such an idea, as a microphone, a dummy head microphone is known for the purpose of picking up sound at positions of the two ears of the listener. The dummy head microphone is configured by mounting microphones at positions of the two ears of a dummy head produced by imitating, for example, the shape and the size of the head and the pinna of a human being.

Figure 2:
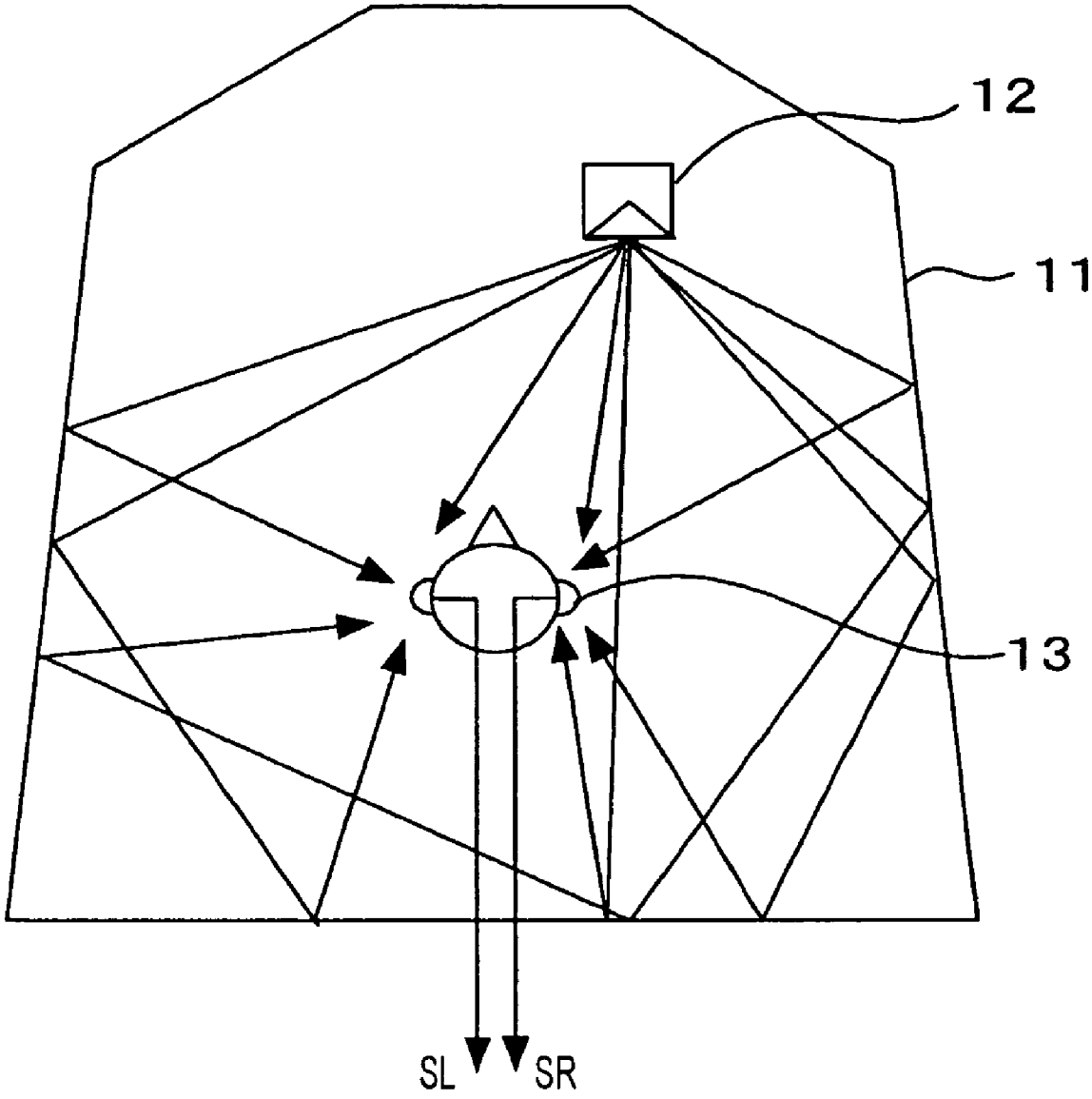
FIG. 2 is an illustration of an example of sound pickup using a dummy head microphone.

FIG. 2 is an illustration of an example of sound pickup using a dummy head microphone. As shown in FIG. 2, when sound pickup is performed using a dummy head microphone 13, originally, the dummy head microphone 13 is arranged at a position where the listener should listen in an actual sound field space 11, and direct sound that directly arrives from an actual sound source 12 and reflected sound that is reflected at a wall, a floor, a ceiling, etc., is picked up using microphones mounted on the corresponding two ear positions of a dummy head. Then, the sounds picked up by the individual microphones are output as a left sound pickup signal SL and a right sound pickup signal SR.

Next, a description will be given, with reference to FIGS. 3A and 3B and FIGS. 4A and 4B, of properties of the sense of hearing regarding the sound image perception of a human being.

The sense of hearing of a human being has properties such that, among sounds originating from the same sound source, the sound image is localized in the direction of the sound that arrives earlier at the ears of the listener. Such properties of a human being are described with reference to FIGS. 3A and 3B.

Figure 3A:
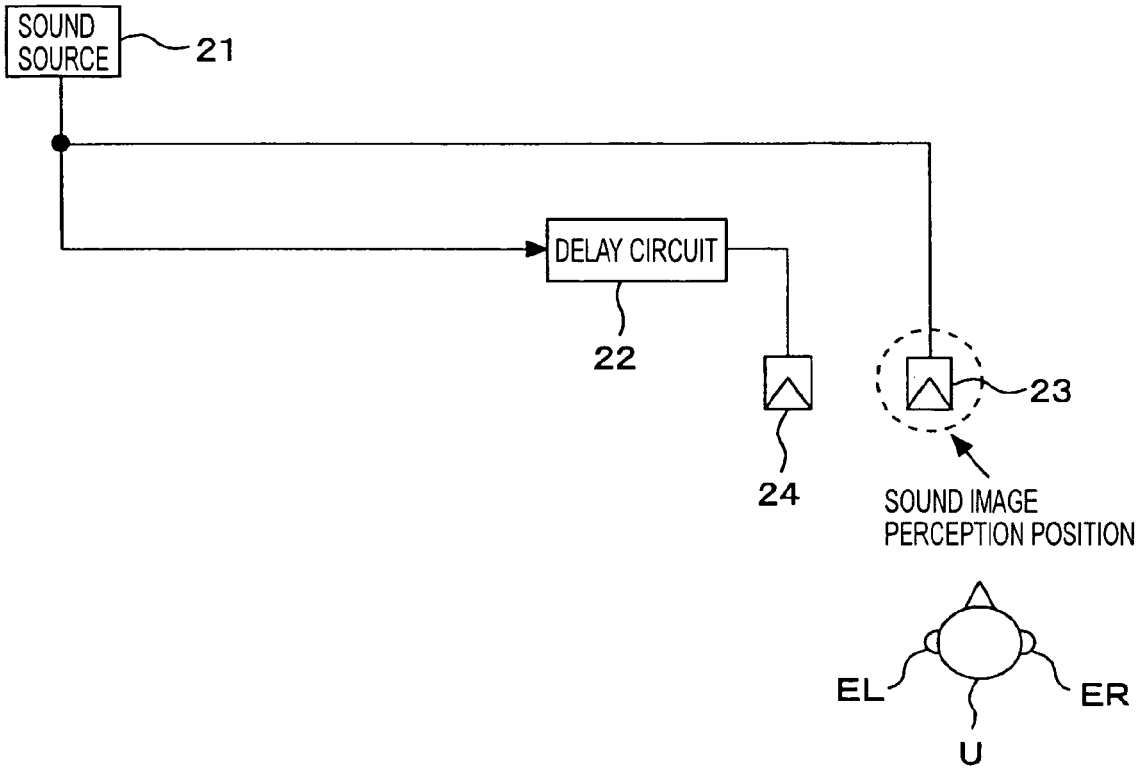
FIGS. 3A and 3B are illustrations of precedence localization.

First, a sound apparatus shown in FIG. 3A is considered. In this case, a sound source signal from a sound source 21 is output as is as a reproduction sound from a speaker 23. Furthermore, a signal such that a sound source signal from the sound source 21 is delayed by a delay circuit 22 is output as a reproduction sound from a speaker 24.

Figure 3B:
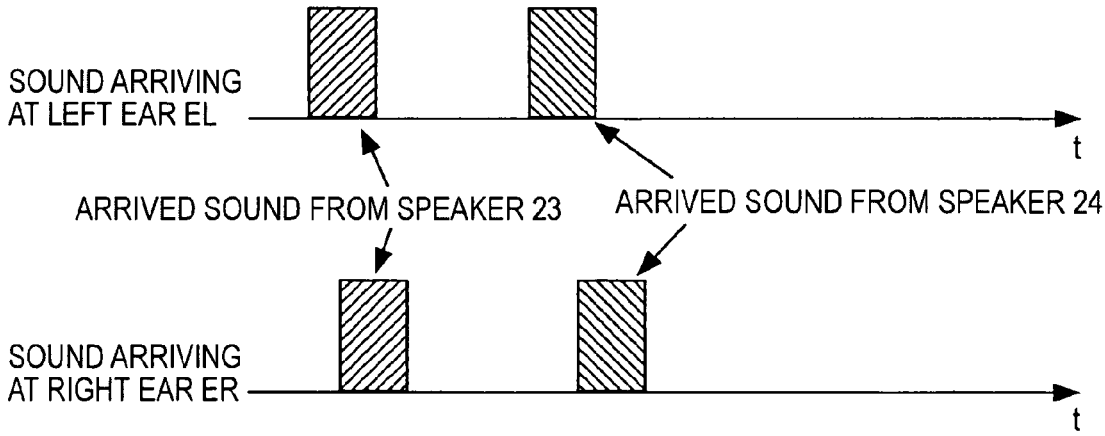

At this time, the reproduction sound arrives at a listener U who listens at a position shown in FIG. 3A at a timing shown in FIG. 3B. That is, first, the reproduction sound of the speaker 23 arrives at the listener U. Then, the reproduction sound of the speaker 24 arrives at a timing that is delayed by the delay time due to the delay circuit 22. In this case, the position of the sound image perception of the listener U, shown in FIG. 3A, becomes the position of the speaker 23, at which the reproduction sound arrives earlier.

The reproduction sound of the speakers 23 and 24, which arrives at the right ear ER of the listener U, arrives slightly later than the reproduction sound from the speakers 23 and 24, which arrives at the left ear EL of the listener U. This is because the distance from the speakers 23 and 24 to the right ear ER of the listener U is longer than the distance from the speakers 23 and 24 to the left ear EL.

The inventors of the present invention have made further studies on the properties of the sense of hearing and have found the following fact. The sense of hearing of a human being separates sound originating from the same sound source into low frequency components and high frequency components, and causes information on the direction of the sound source to be contained in the low frequency components, and if the low frequency components are output earlier, the listener can clearly perceive the sound localization even if the information of the sound source direction contained in the high frequency components is not accurate.

Such properties of the sense of hearing of a human being are described with reference to FIGS. 4A and 4B. In the sound apparatus shown in FIG. 4A, a low-pass filter 25 is provided between the sound source 21 and the speaker 23, and a high-pass filter 26 and a delay circuit 22 are provided between the sound source 21 and the speaker 24.

Therefore, from the speaker 23, only the sound source signal of the sound source 21 that passes through the low-pass filter 25 is output as a reproduction sound. Furthermore, from the speaker 24, only the signal such that the sound source signal of the high frequency components of the sound source 21 that passes through the high-pass filter 26 is delayed by the delay circuit 22 is output as a reproduction sound.

Figure 4A:
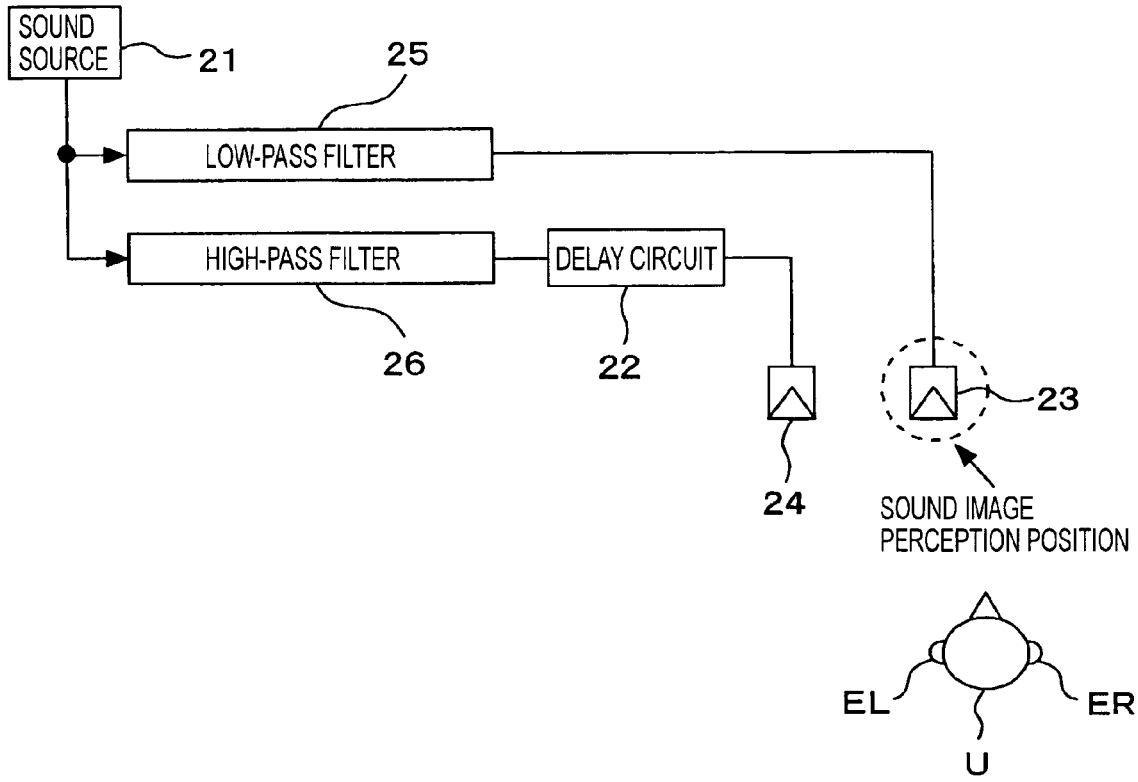
FIGS. 4A and 4B are illustrations of precedence localization.
Figure 4B:
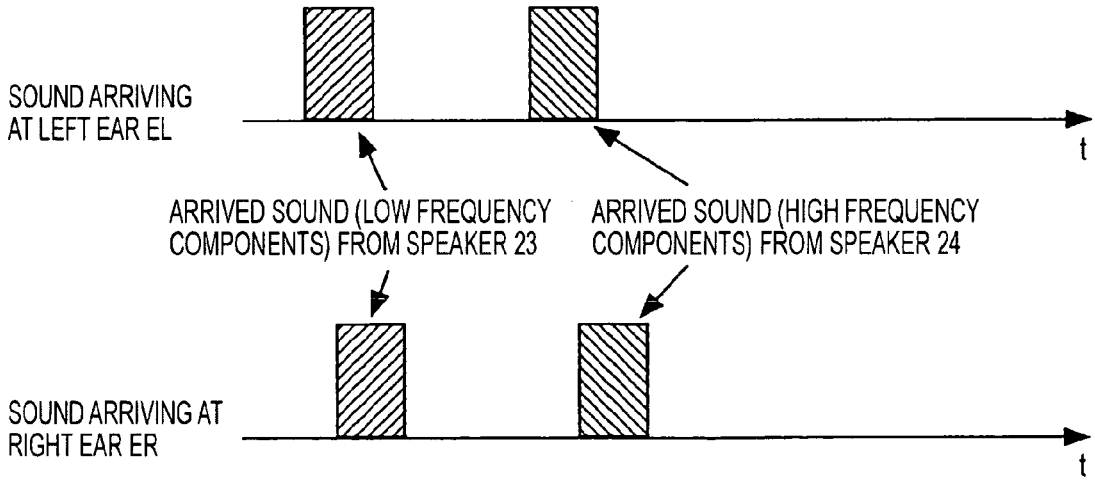

At this time, the reproduction sound arrives at the listener U who listens at the position shown in FIG. 4A at the timing shown in FIG. 4B. That is, also, in this case, first, the reproduction sound (the low frequency components) of the speaker 23 arrives at the listener U. Then, the reproduction sound (the high frequency components) of the speaker 24 arrives at the listener U at a timing delayed by the delay time due to the delay circuit 22. Therefore, the listener U shown in FIG. 4A obtains the perception of the sound image by the reproduction sound of the speaker 23 that arrives earlier, that is, the low tone range reproduced from the speaker 23. Then, in this case, it is possible to enable the listener U to clearly perceive the sound image with respect to the sound of the sound source, which is the same as the low tone range reproduced from the speaker 23.

In a conventional stereo reproduction system using an intensity-based method, for example, reproduction sound that is reproduced from the left speaker arrives at not only the left ear of the listener, but also the right ear. For this reason, when the sound pickup signal picked up by the dummy head microphone 13 shown in FIG. 2 is reproduced by a stereo reproduction system using an intensity-based method, the left ear sound corresponding to the left sound pickup signal SL picked up by the dummy head microphone 13 and the right ear sound corresponding to the right sound pickup signal SR not only arrive at the corresponding left and right ears of the listener, but also arrive at the ears on the opposite sides.

Accordingly, it has been known that, when the left sound pickup signal and the right sound pickup signal picked up by the dummy head microphone are to be reproduced by a two-channel stereo reproduction system, a stereophonic sound reproduction signal generation filter capable of canceling propagation characteristics from a playback speaker to the ears of the listener in a listening room is used. Then, if such a stereophonic sound reproduction signal generation filter is used, the signal input to the left channel of the filter is reproduced at only the left ear of the listener, and the signal input to the right channel of the filter is reproduced at only the right ear of the listener.

Figure 5:
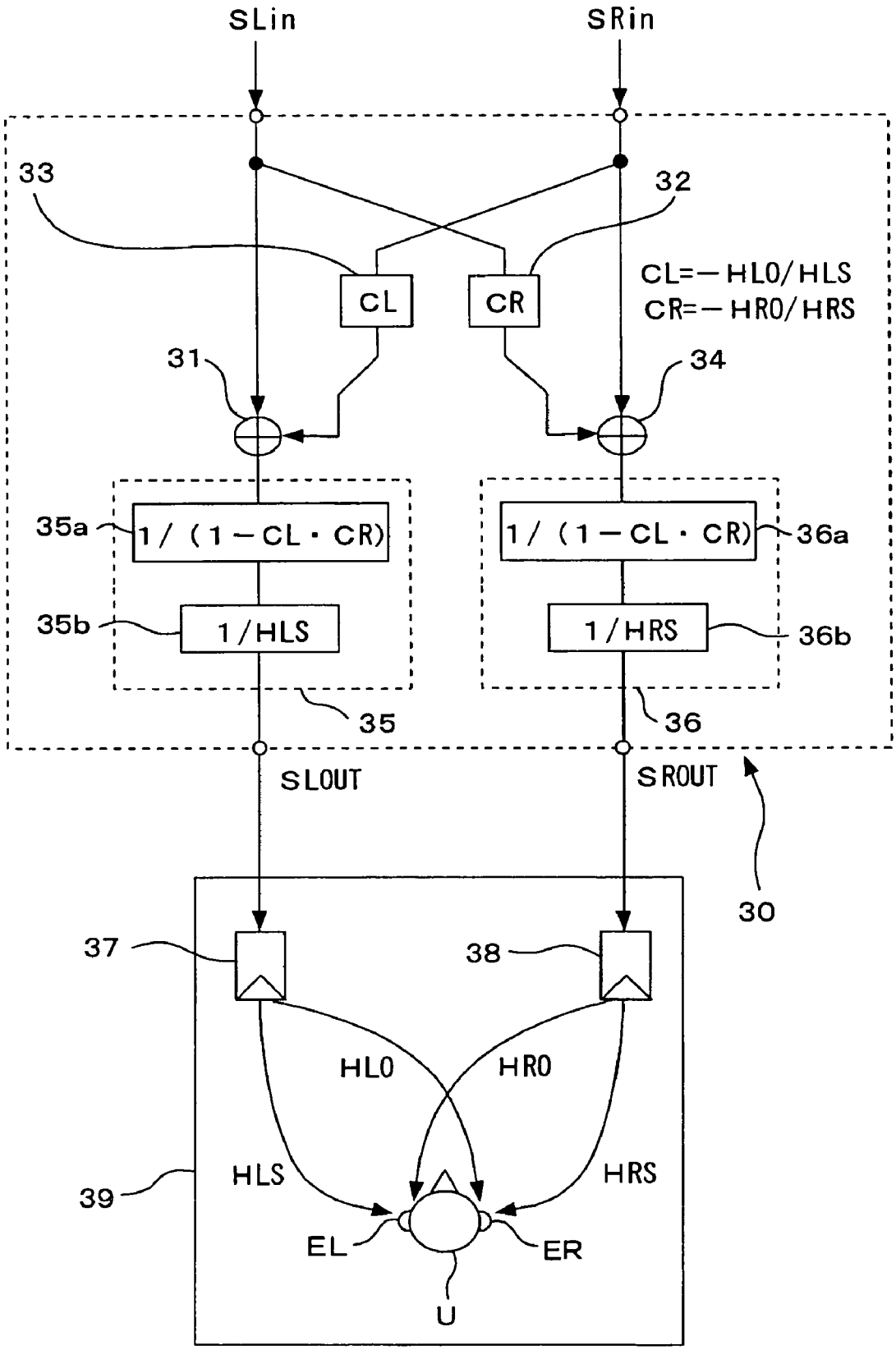
FIG. 5 shows the configuration of a stereophonic sound reproduction signal generation filter.

FIG. 5 shows the configuration of a stereophonic sound reproduction signal generation filter. In FIG. 5, a description is given by using as an example a case in which a speaker is arranged to the left and to the right in the front of the listener U.

In FIG. 5, a head diffraction transfer function of a path that starts from a left speaker 37 and that reaches the left ear EL of the listener U in a reproduction sound field space 39 is denoted as HLS, and a head diffraction transfer function of a path that starts from a right speaker 38 and that reaches the right ear ER of the listener U is denoted as HRS. Furthermore, a head diffraction transfer function of a path that starts from the left speaker 37 and that reaches the right ear ER of the listener U is denoted as HL0, and a head diffraction transfer function of a path that starts from the right speaker 38 and that reaches the left ear EL of the listener U is denoted as HR0.

In a stereophonic sound reproduction signal generation filter 30 shown in FIG. 5, a left sound pickup signal SLin from a dummy head microphone (not shown in FIG. 5) is input as a left channel signal, and a right sound pickup signal SRin is input as a right channel signal. The left sound pickup signal SLin that is used as a left channel signal is input to an adder 31 and a crosstalk canceling section 32. The right sound pickup signal SRin that is used as a right channel signal is input to an adder 34 and a crosstalk canceling section 33.

For the crosstalk canceling sections 32 and 33, filters for canceling crosstalk components to the right ear ER of the listener U from the left speaker 37 and crosstalk components to the left ear EL of the listener U from the right speaker 38 are used respectively. In this case, propagation characteristics CR of the crosstalk canceling section 32 are denoted as −HRO/HRS, and propagation characteristics CL of the crosstalk canceling section 33 are denoted as −HLO/HLS.

Such a left sound pickup signal SLin that passes through the crosstalk canceling section 32 is input as a cancel signal to the adder 34. The right sound pickup signal SRin that passes through the crosstalk canceling section 33 is input as a cancel signal to the adder 31.

The adder 31 adds together the left sound pickup signal SLin and the cancel signal, which are input from the crosstalk canceling section 33, and outputs the signals. The output of the adder 31 is supplied to a correction block section 35. The adder 34 adds together the right sound pickup signal SRin and the cancel signal, which are input from the crosstalk canceling section 32, and supplies the signals to a correction block section 36.

The correction block section 35 is a block section for correcting the reproduction system, including the left speaker 37, with respect to the left channel. The correction block section 35 is formed by a correction section 35*a* for correcting changes of the characteristics, which occur due to the crosstalk canceling section 33, and a speaker correction section 35*b* for correcting speaker characteristics. The propagation characteristics of the correction section 35*a* are denoted as 1/(1−CL·CR). The propagation characteristics of the correction section 35*b* are denoted as 1/HLS. The output of the correction block section 35 is output as a left sound pickup signal SLout from the stereophonic sound reproduction signal generation filter 30.

The correction block section 36 is a block section for correcting the reproduction system, including the right speaker 38, with respect to the right channel. The correction block section 36 is formed by a correction section 36*a* for correcting changes of the characteristics, which occur due to the crosstalk canceling section 32, and a speaker correction section 36*b* for correcting speaker characteristics. The propagation characteristics of the correction section 36*a* are denoted as 1/(1−CL·CR). The propagation characteristics of the correction section 36*b* are denoted as 1/HRS. The output of the correction block section 36 is output as a right sound pickup signal SRout from the stereophonic sound reproduction signal generation filter 30.

Then, the left sound pickup signal SLout output from the stereophonic sound reproduction signal generation filter 30 is input to the left speaker 37 in the reproduction sound field space 39, and the right sound pickup signal SRout is input to the right speaker 38 in the reproduction sound field space 39. As a result, at the left ear EL of the listener U in the reproduction sound field space, only the left ear sound corresponding to the left sound pickup signal SLin input to the stereophonic sound reproduction signal generation filter 30 can be reproduced. At the right ear ER of the listener U, similarly, only the right ear sound corresponding to the right sound pickup signal SRin input to the stereophonic sound reproduction signal generation filter 30 can be reproduced.

Here, since the head-related transfer function of a human being differs for each listener, which has been conventionally problematical, strictly speaking, a dummy head microphone needs to be provided for each listener. Furthermore, since the head diffraction transfer functions HLS, HL0, HRs, and HR0 depend strongly on the listener, it is necessary to measure the head-related transfer function for each individual in order to provide the best sound image quality to the listener. However, in practice, since sound pickup is performed by using a dummy head microphone having standard characteristics and a head diffraction transfer function, satisfactory sound image quality cannot be provided.

However, there are hardly any differences between the sound characteristics for each listener and the standard sound characteristics determined by directional characteristics and a head-related transfer function of a standard dummy head microphone up to approximately 1 kHz, but the differences tend to increase at approximately 3 kHz or higher.

Based on the description up to this point, a sound apparatus according to the present embodiment is described below.

Figure 6:
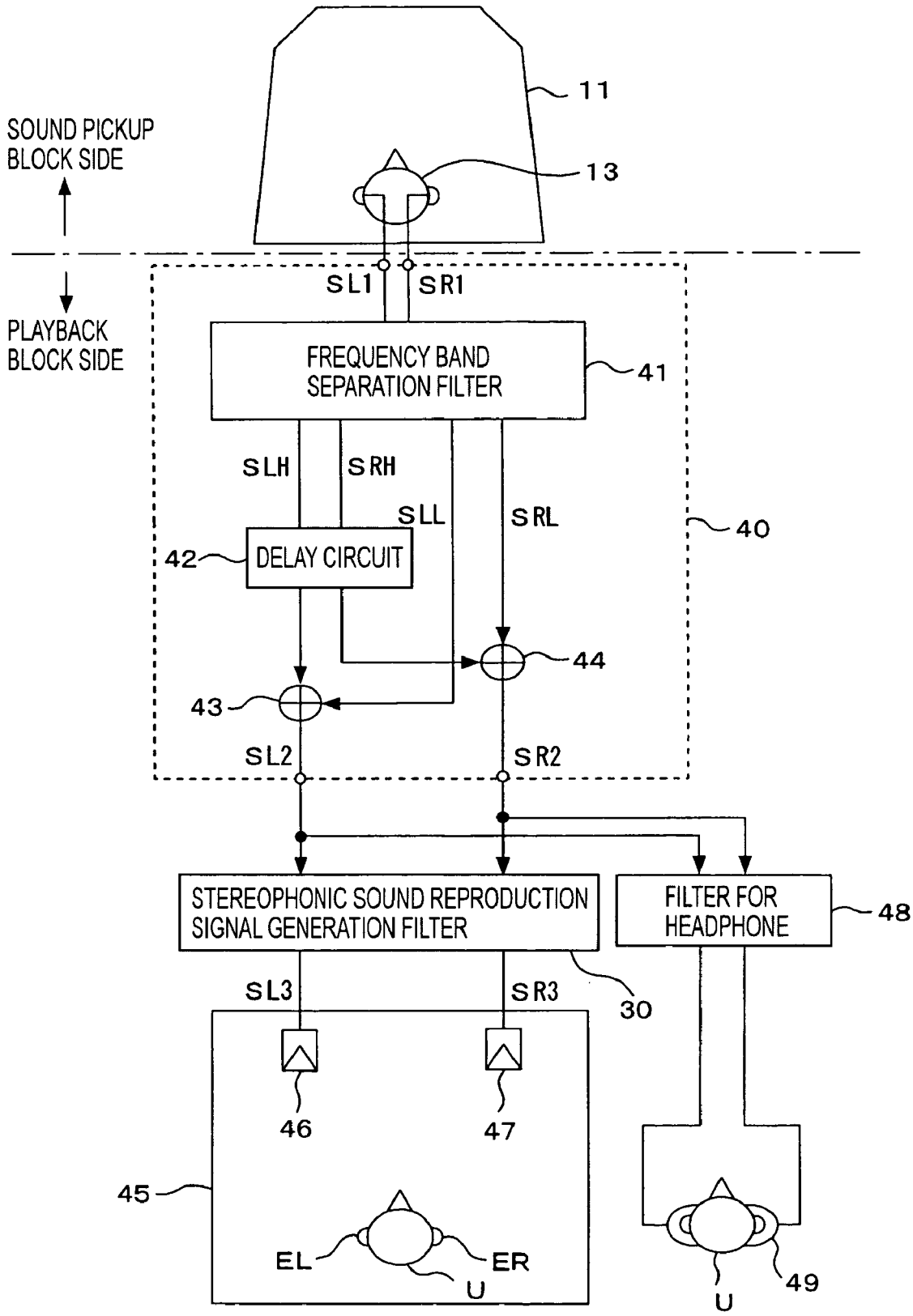
FIG. 6 shows the configuration of a sound apparatus according to a first embodiment of the present invention.

FIG. 6 shows the configuration of a sound apparatus according to a first embodiment of the present invention. The sound apparatus shown in FIG. 6 is formed of a sound pickup block and a playback block, which are sound reproduction apparatuses. The sound pickup block is formed by the dummy head microphone 13 arranged in the actual sound field space 11. In the sound pickup block, sound is picked up by the dummy head microphone 13, and a left sound pickup signal SL1 and a right sound pickup signal SR1, which are converted into electrical signals, are output to a microphone amplifying section 40 on the playback block side.

The microphone amplifying section 40 includes a frequency band separation filter 41, a delay circuit 42, and adders 43 and 44.

The frequency band separation filter 41 separates the left sound pickup signal SL1 and the right sound pickup signal SR1, which are input from the dummy head microphone 13, into corresponding signals of low frequency components (low frequency signals) SLL and SRL, and signals of high frequency components (high frequency signals) SLH and SRH with, for example, approximately 3 kHz being set as a boundary. The reason for setting the boundary frequency to 3 kHz in this embodiment is that the error between the standard dummy head microphone 13 and the head diffraction transfer function of the listener begins to increase from approximately 1 kHz, further increases when exceeding approximately 3 kHz, and the fundamental frequency components of speech, musical instrument sounds, etc., are contained within 3 kHz at the highest.

The boundary frequency of the frequency band separation filter 41 needs not always to be set to 3 kHz, and may be set to any frequency between, for example, 1 kHz and 3 kHz.

The left high frequency signal SLH and the right high frequency signal SRH, which are separated by the frequency band separation filter 41, are input to the delay circuit 42. In the delay circuit 42, the left high frequency signal SLH and right high frequency signal SRH, which are input, are delayed by a set delay time and are output.

In this case, the left high frequency signal SLH and the right high frequency signal SRH in the delay circuit 42 are output by being delayed by several milliseconds to several tens of milliseconds from the output timing of the left low frequency signal SLL and the right low frequency signal SRL. However, such a delay time needs only to be set within a time in which the high tone range that is finally reproduced by being delayed is not heard as echo sound of a low tone range to the listener U.

The adder 43 adds together the left high frequency signal SLH from the delay circuit 42 and the left low frequency signal SLL from the frequency band separation filter 41. Then, the added output of the adder 43 is output as a left sound pickup signal SL2.

The adder 44 adds together the right high frequency signal SRH from the delay circuit 42 and the right low frequency signal SRL from the frequency band separation filter 41. Then, the added output of the adder 44 is output as a right sound pickup signal SR2.

Here, when the playback block is formed of speakers of two channels, the left sound pickup signal SL2 and the right sound pickup signal SR2 output from the microphone amplifying section 40 are input to the stereophonic sound reproduction signal generation filter 30.

As described above with reference to FIG. 5, for the stereophonic sound reproduction signal generation filter 30, a filter capable of canceling propagation characteristics from speakers 46 and 47 to the ears of the listener U is used. Thus, the left sound pickup signal SL2 and the right sound pickup signal SR2 input from the microphone amplifying section 40 are input as a left sound pickup signal SL3 and a right sound pickup signal SR3 to the corresponding speakers 46 and 47.

Therefore, as a result of the sound apparatus being configured in this manner, the left ear sound picked up at the position of the left ear of the dummy head microphone 13 arranged in the actual sound field space 11 can be reproduced at only the left ear EL of the listener U in a reproduction sound field space 45. Furthermore, the right ear sound picked up at the position of the right ear of the dummy head microphone 13 can be reproduced at only the right ear ER of the listener U.

On the other hand, when the playback block is formed of a headphone, the left sound pickup signal SL2 and the right sound pickup signal SR2 output from the microphone amplifying section 40 are input to a headphone 49 via a filter 48 for a headphone. For the filter 48 for a headphone, a filter for making corrections in accordance with the characteristics of the headphone 49 is used.

Therefore, also, in this case, at the left ear EL of the listener U in which the headphone 49 is installed, only the left ear sound picked up at the position of the left ear of the dummy head microphone 13 in the actual sound field space 11 can be reproduced. Furthermore, at the right ear ER of the listener U, only the right ear sound picked up at the position of the right ear of the dummy head microphone 13 can be reproduced.

In addition, in the sound apparatus according to this embodiment, in whichever case of the two-channel speaker playback and the headphone playback, in the microphone amplifying section 40, only the high frequency components of the left sound pickup signal SL1 and the right sound pickup signal SR1 input from the dummy head microphone 13 are delayed by the delay circuit 42. That is, in this embodiment, only the high frequency components are delayed in which the influence of the head-related transfer function for which the individual differences are large tends to appear as sound image perception.

Therefore, according to the sound apparatus shown in FIG. 6, since the reproduction sound of the low frequency components for which the individual differences are small is output earlier from the speaker, it becomes possible for the listener U to perceive the sensation of sound localization by the reproduction sound of the low frequency components that arrive earlier.

More specifically, according to the sound apparatus of this embodiment, since the influence of the individual differences with respect to the sound image perception can be reduced, even when the stereophonic sound reproduction signal generation filter 30 is configured by using a standard head-related transfer function, it is possible to enable the listener U to perceive a target sensation of sound localization, for example, a sensation of sound localization as if the listener is in the actual sound field space 11.

Furthermore, even when a binaural sound pickup signal picked up using the dummy head microphone 13 having a standard head-related transfer function is input, it is possible to enable the listener U to experience a target sensation of sound localization.

In this case, by supplementing the shortage of the entire energy by the high tone range, the musical characteristics as a whole does not deteriorate.

Although the embodiment has been discussed above by assuming that the delay circuit 42 is provided independently in the sound apparatus shown in FIG. 6, the delay circuit 42 needs not always to be provided independently. For example, the delay circuit 42 may also be configured by using the phase delay characteristics of the frequency band separation filter 41.

Figure 7:
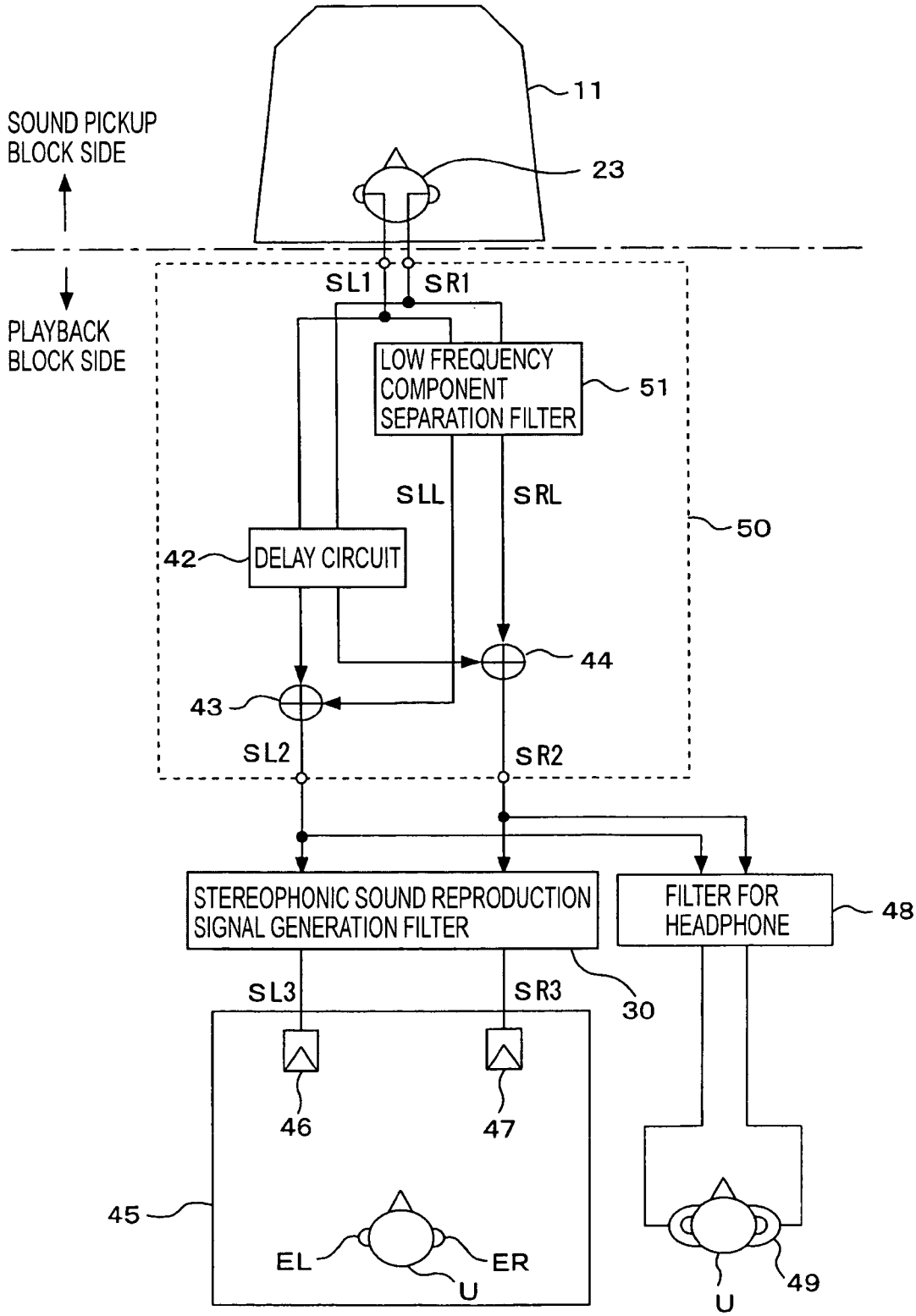
FIG. 7 shows the configuration of a sound apparatus according to a second embodiment of the present invention.

FIG. 7 shows the configuration of a sound apparatus according to a second embodiment of the present invention. Components of the sound apparatus in FIG. 7, which are identical to the components of the sound apparatus shown in FIG. 6, are designated with the same reference numerals, and accordingly, detailed descriptions thereof are omitted. The sound apparatus shown in FIG. 7 differs from the sound apparatus shown in FIG. 6 in the configuration of a microphone amplifying section 50 provided in the sound pickup block.

In the microphone amplifying section 50 in this case, the left sound pickup signal SL1 and the right sound pickup signal SR1 input from the dummy head microphone 13 are input to the delay circuit 42 and a low-pass filter 51.

In the low-pass filter (LPF) 51, for example, only the low frequency components lower than or equal to 3 kHz are separated from the left sound pickup signal SL1 and right sound pickup signal SR1, which are input.

Although, in this embodiment, the frequency band that can be separated by the low-pass filter 51 is set to be lower than or equal to 3 kHz, this is only an example. Of course, the frequency band can be set to any frequency between, for example, 1 kHz to 3 kHz.

The left low frequency signal SLL output from the low-pass filter 51 is input to the adder 43. The right low frequency signal SRL output from the low-pass filter 51 is output to the adder 44.

In the adder 43, the left sound pickup signal SL1 delayed by the delay circuit 42 and the left low frequency signal SLL from the low-pass filter 51 are added together, and the added output is output as a left sound pickup signal SL2. In the adder 44, the right sound pickup signal SR1 delayed by the delay circuit 42 and the right low frequency signal SRL from the low-pass filter 51 are added together, and the added output is output as a right sound pickup signal SR2.

More specifically, the microphone amplifying section 50 of the sound apparatus shown in FIG. 7 is such that, in place of the frequency band separation filter 41 provided in the microphone amplifying section 40 shown in FIG. 6, the low-pass filter 51 for separating only the low frequency components is provided.

Also, when the sound apparatus is configured as shown in FIG. 7, the reproduction sound of the low frequency components is output earlier from the speakers 46 and 47. Therefore, in any case of the two-channel speaker playback and the headphone playback, it is possible to enable the listener U to perceive the sensation of sound localization by the reproduction sound of the low frequency components that arrive earlier.

That is, similarly to the sound apparatus shown in FIG. 6, even when the stereophonic sound characteristics of the stereophonic sound reproduction signal generation filter 30 are set by using a standard head-related transfer function, it is possible to enable the listener U to perceive the target sensation of sound localization. Also, when sound pickup is performed using the dummy head microphone 13 having a standard head-related transfer function, it is possible to enable the listener U to perceive the target sensation of sound localization.

In the sound apparatus shown in FIGS. 6 and 7, a sound pickup signal is obtained by binaural sound pickup from the actual sound field space 11 by using the dummy head microphone 13. However, this is only an example, and even when microphones are installed at both ears of a human being in place of a dummy head, a sound pickup signal can also be obtained by binaural sound pickup in a similar manner.

In the sound apparatus described up to this point, by picking up the left sound pickup signal SL1 and the right sound pickup signal SR1 input to the sound pickup block by mounting a dummy head microphone or by mounting microphones at both ears of a human being, binaural sound pickup is performed. This is only an example, and, for example, it is also possible to use a sound source signal that is not picked up by binaural sound pickup.

Such a sound apparatus is described next.

Figure 8:
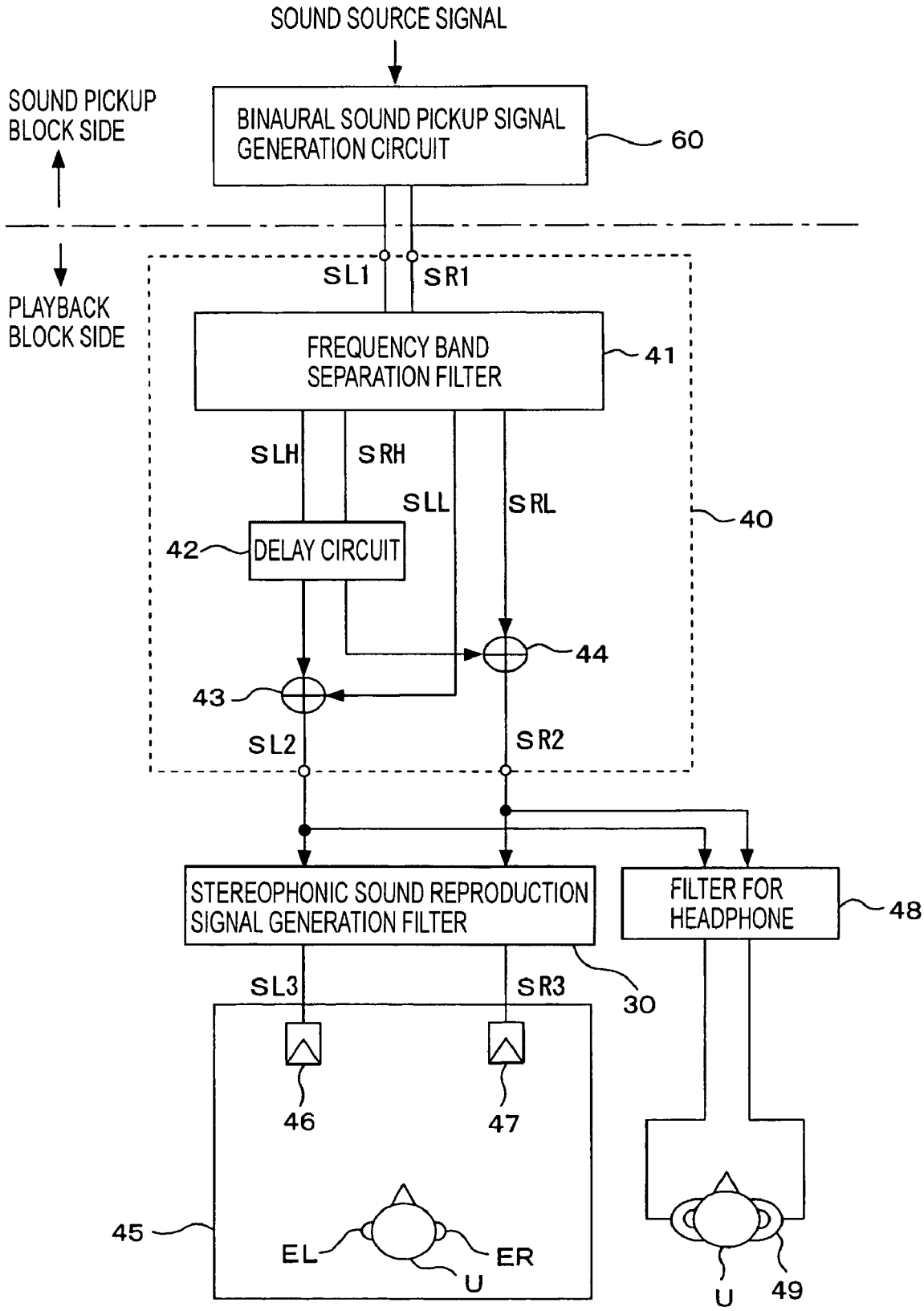
FIG. 8 shows the configuration of a sound apparatus according to a third embodiment of the present invention.

FIG. 8 shows the configuration of a sound apparatus according to a third embodiment of the present invention. Components of the sound apparatus shown in FIG. 8, which are identical to the components of the sound apparatus shown in FIG. 6, are designated with the same reference numerals, and accordingly, detailed descriptions thereof are omitted. The sound apparatus shown in FIG. 8 differs from the sound apparatus shown in FIG. 6 in that a binaural sound pickup signal generation circuit 60 is provided.

In this case, in the binaural sound pickup signal generation circuit 60, for example, by superposing, on the sound source signal, the propagation characteristics for each propagation path of sound waves and the head-related transfer function for each incidence angle to the listening position in an indoor space, a signal such that the total sum for the propagation paths is a hearing sound is obtained. As a result, in the binaural sound pickup signal generation circuit 60, signals corresponding to the binaural sound pickup signals, that is, signals corresponding to the left sound pickup signal SL1 and the right sound pickup signal SR1, are obtained from the sound source signal.

At this time, the sound source signal input to the binaural sound pickup signal generation circuit 60 may be any of an audio signal of an existing source, an audio signal synthesized by an electronic musical instrument, etc. For the above audio method, any audio method, for example, a monaural method, a stereo method, and a surround method, may be used.

A description will now be given, with reference to FIGS. 9A and 9B to FIGS. 14A and 14B, of an example of a method for generating a left sound pickup signal and a right sound pickup signal in the binaural sound pickup signal generation circuit 60.

In order to generate the left sound pickup signal SL1 and the right sound pickup signal SR1 in the binaural sound pickup signal generation circuit 60, first, based on the acoustic characteristics of a concert hall, etc., and the radiation directional characteristics of the sound source, how the sound radiated from the sound source propagates in the indoor space is computed. More specifically, first, based on wall surface acoustic characteristics such as the sound reflection/absorption characteristics of the shape of the acoustic space such as a concert hall, a wall surface, a floor, and a ceiling, the radiation directional characteristics of the sound source position and the sound source, and the directional characteristics of the listening point position and the hearing microphone, the propagation characteristics of sound waves from the sound source to the listening position are computed.

Figure 9A:
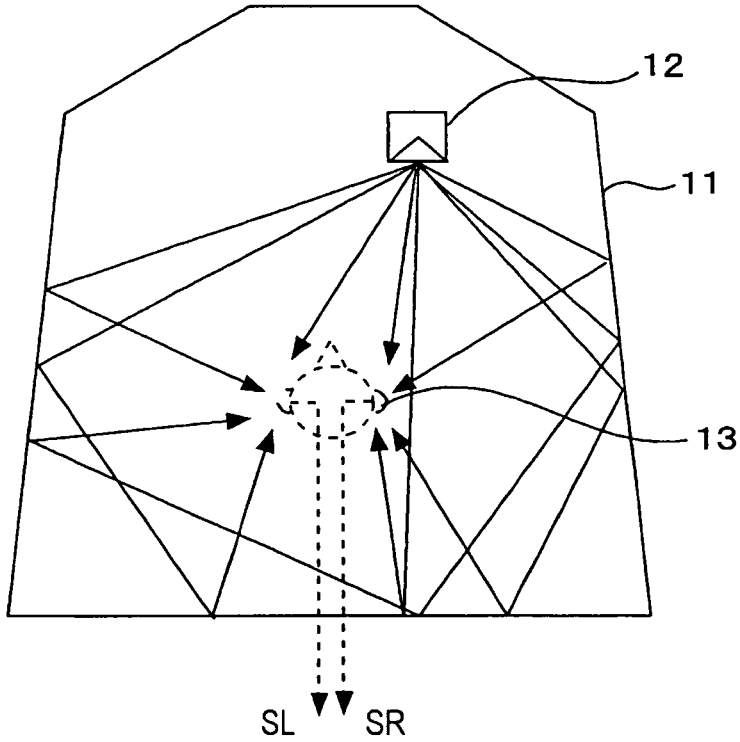
FIGS. 9A and 9B show propagation paths from the position of a sound source to the left and right ears of a listener in an indoor space.

FIG. 9A is a schematic view showing an actual propagation path from the position of the sound source to both ears of the listener in an indoor space. In the actual sound field space 11, such as a concert hall, shown in FIG. 9A, sound waves are reflected on the wall surface, the floor, the ceiling, etc., and arrive toward the listening position (in this case, the dummy head microphone 13 indicated by the broken line is arranged at the listening position) from various directions.

Figure 9B:
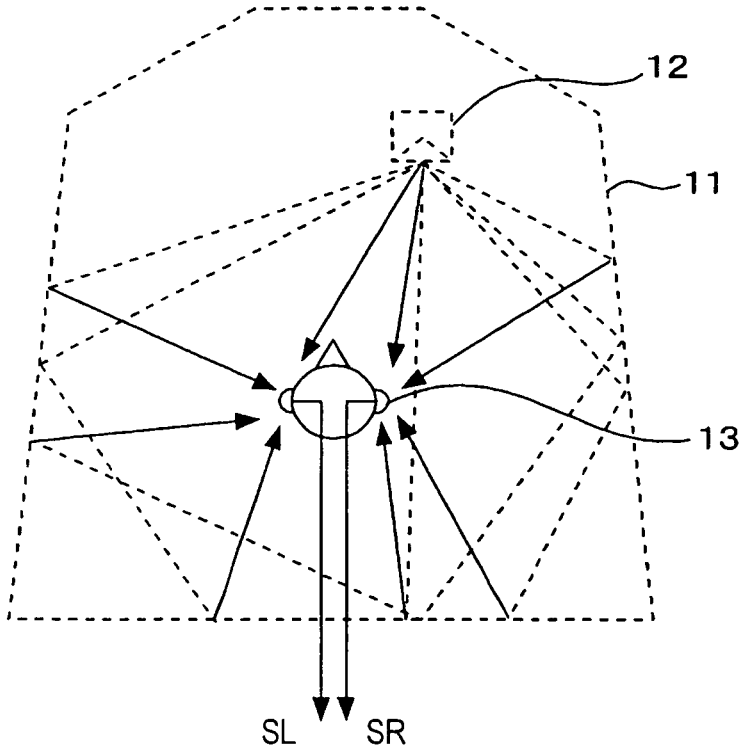

Here, in order to precisely compute by simulation the propagation of sound waves shown in FIG. 9A from the sound source to the listening position, as indicated by the solid line in FIG. 9B, the direction of the sound source and the distance to the sound source when viewed from the listening position are computed, and the sound source signal is superposed on the head diffraction transfer function data in the direction of the sound source and at the distance to the sound source.

At this time, the head diffraction transfer function data in the direction of the sound source and at the distance to the sound source may be obtained as follows. That is, the head diffraction transfer function data is measured in advance for each direction of the sound source and for each distance to the sound source. The head diffraction transfer function data of the closest angle is extracted from the head diffraction transfer function data from among the head diffraction transfer function data stored in the memory, and based on the data, the head diffraction transfer function data of a desired angle (the direction of the sound source) is obtained by an interpolation process.

The above-described head diffraction transfer function data differs depending not only on the direction of the sound source but also on the distance from the sound source. The reason for this is that, as shown in FIGS. 10A and 10B, when the distances from the left and right ears of the listener to the position of the sound source differs from each other, the incidence angle differs even if the direction θ of the sound source is the same.

Figure 10A:
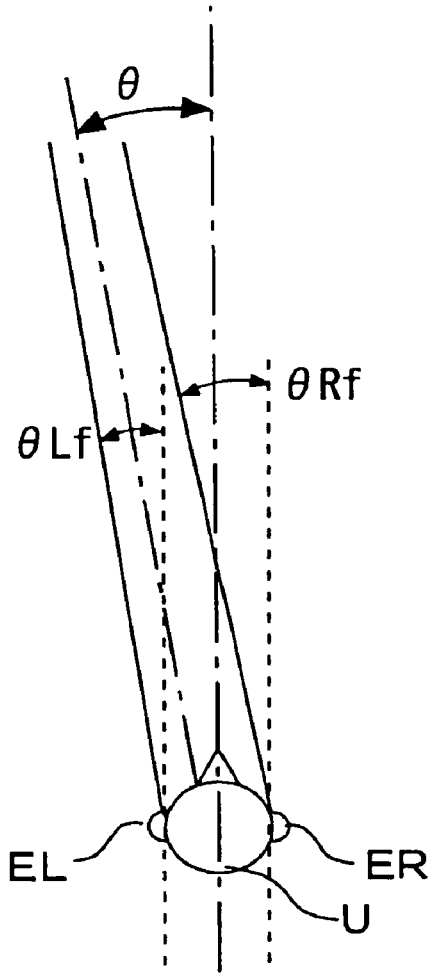
FIGS. 10A and 10B are illustrations showing changes in the incidence angle to ears according to the distance from the sound source.

For example, when the sound source 11 exists at a position away from the listener U, the incidence angle θLf of sound waves that arrive at the left ear EL of the listener U and the incidence angle θRf of sound waves that arrive at the right ear ER of the listener U are shown in FIG. 10A. In comparison, when the sound source 11 is near the listener U, the incidence angle θLn of sound waves that arrive at the left ear EL of the listener U and the incidence angle θRn of sound waves that arrive at the right ear ER of the listener U are shown in FIG. 10B.

Figure 10B:
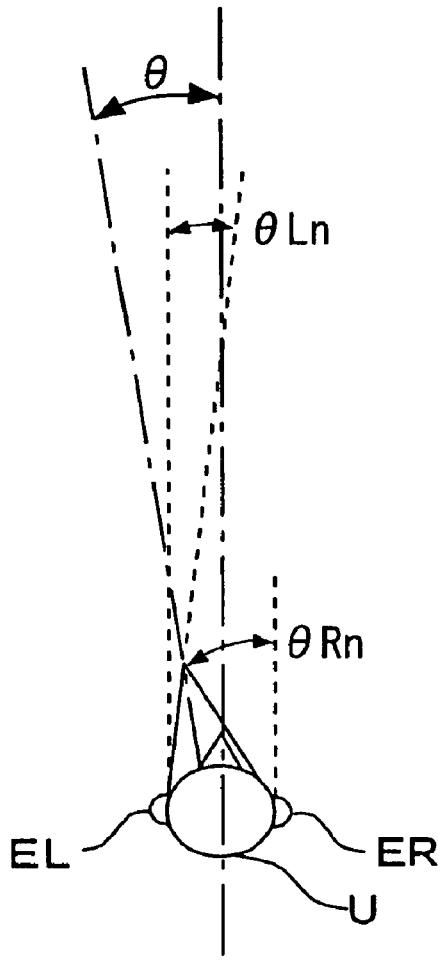

Therefore, as can be seen from FIGS. 10A and 10B, when the distance from the listener U to the sound source differs, the incidence angle at which the sound waves are incident onto the left and right ears of the listener U differs even if the direction θ of the sound source is the same, with the result that the head diffraction transfer function data differs.

For this reason, as shown in FIGS. 11A and 11B, correspondence tables in which the direction of the sound source with respect to both ears of the listener corresponds to the head diffraction transfer function data are provided according to the distance from the sound source to far. For example, FIG. 11A shows an example of a correspondence table when the distance from the position of the sound source to the listening position is a long distance. FIG. 11B shows an example of a correspondence table when the distance from the position of the sound source to the listening position is near.

In such a correspondence table, if there is no limitation on the storage capacity of the memory in which the data is stored, it is also possible to subdivide the distance to the sound source, so that the correspondence table of head diffraction transfer function data, in which the subdivided distances and the direction of the sound source are parameters, is stored in the memory.

Figure 12A:
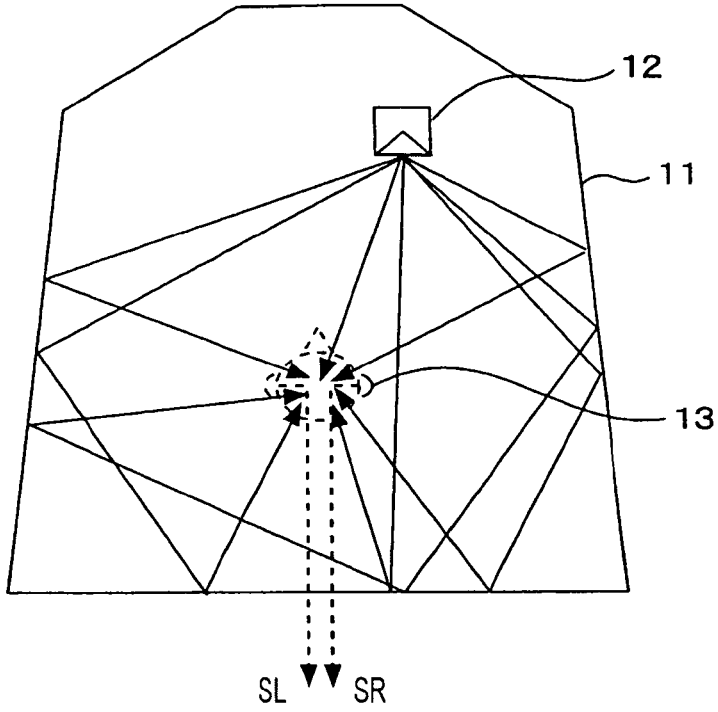
FIGS. 12A and 12B show propagation paths from the position of a sound source to the center position of a listener in an indoor space.
Figure 12B:
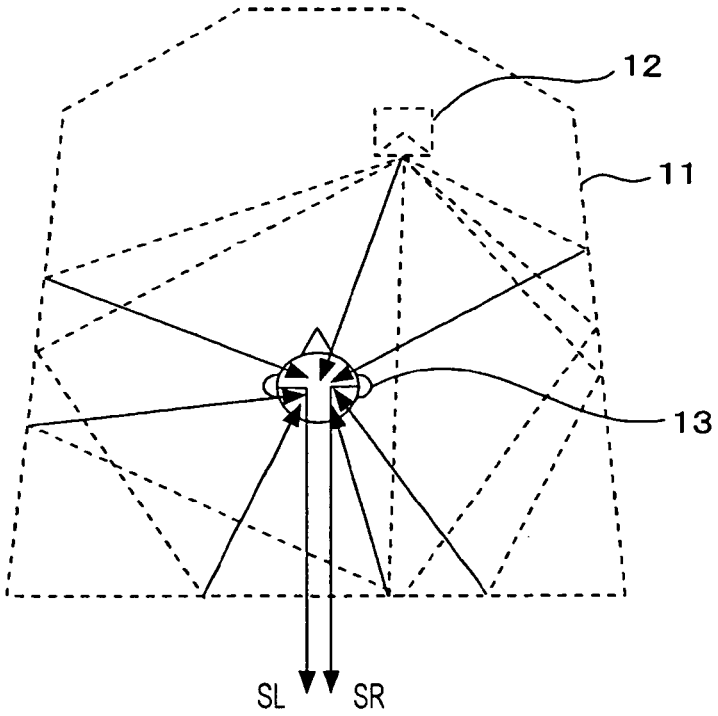

FIG. 12A is a schematic view showing an actual propagation path from the position of the sound source to the center position of the listener at the listening position in an indoor space. Also, in this case, sound waves arrive at the dummy head microphone 13 at the listening position from various directions. Also, in this case, in order to precisely compute by simulation the propagation of sound waves from the sound source 12 to the listening position, as indicated by the solid line in FIG. 12B, the direction of the sound source and the distance to the sound source when viewed from the listening position are computed, and the sound source signal is superposed on the head diffraction transfer function data in the direction of the sound source and at the distance to the sound source.

At this time, similarly to that described above, the head diffraction transfer function data in the direction of the sound source and at the distance to the sound source may be obtained as follows. That is, the head diffraction transfer function data is measured in advance for each direction of the sound source and for each distance to the sound source. The head diffraction transfer function data of the closest angle is extracted from the head diffraction transfer function data from among the head diffraction transfer function data stored in the memory, and based on the data, the head diffraction transfer function data of a desired angle (the direction of the sound source) is obtained by an interpolation process.

Figure 13:
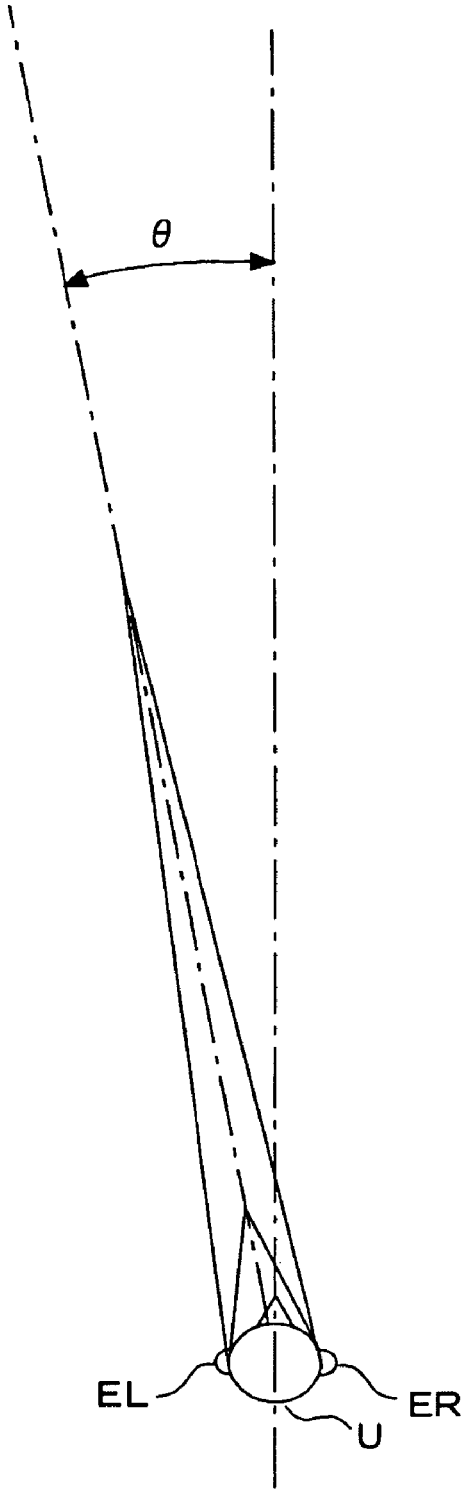
FIG. 13 is an illustration of a change in the incidence angle to the ears according to the distance from the sound source.

Also, the head diffraction transfer function data in this case differs according to not only the direction of the sound source but also the distance from the sound source. The reason for this is that, as shown in FIG. 13, when the distance from the center position of the listener to the sound source differs, the incidence angle differs even if the sound source direction θ is the same.

For this reason, as shown in FIGS. 14A and 14B, a correspondence table in which the direction of the sound source with respect to the center position of the listener corresponds to the head diffraction transfer function data is provided according to the distance from the sound source to the listening position.

In such a correspondence table, if there is no limitation on the storage capacity of the memory for storage, of course, it is also possible to subdivide the distance to the sound source, so that the correspondence table of head diffraction transfer function data, in which the distance to the sound source and the direction of the sound source are parameters, is stored in the memory.

The sound pickup block of the sound apparatus according to this embodiment may be configured in another way. FIGS. 15 to 18 show other examples of the configuration of the sound pickup block of the sound apparatus according to this embodiment. In FIGS. 15 to 18, only the configuration of the speaker reproduction system for one channel from among the two-channel speaker playback blocks is shown.

Figure 15:
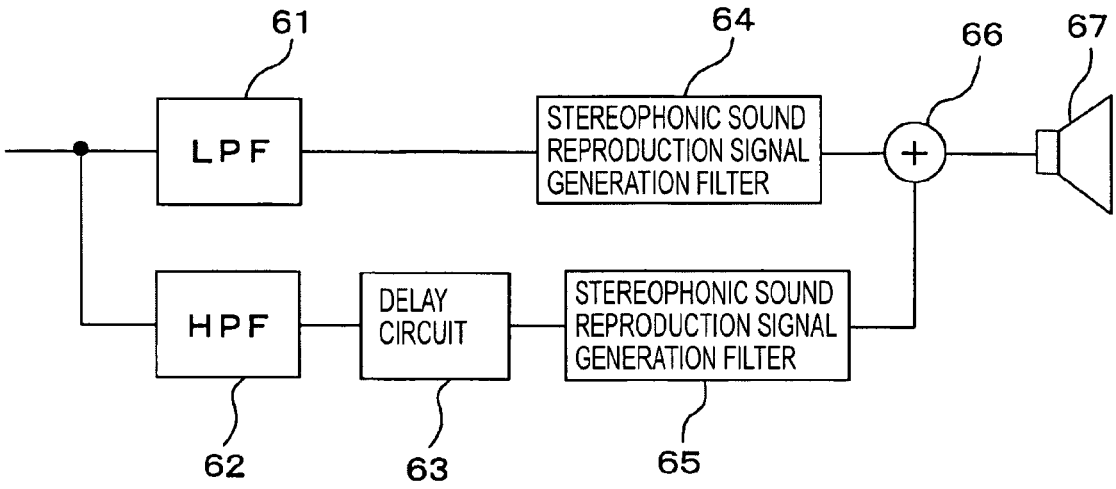
FIG. 15 shows another configuration of the sound apparatus according to this embodiment.

The playback block shown in FIG. 15 includes a low-pass filter (LPF) 61, a high-pass filter (HPF) 62, a delay circuit 63, stereophonic sound reproduction signal generation filters 64 and 65, an adder 66, and a speaker 67.

In the playback block shown in FIG. 15, the stereophonic sound reproduction signal generation filter 64 performs a filtering process for generating a stereophonic sound reproduction signal with respect to low frequency components that pass through the low-pass filter (LPF) 61 from among the input signals from the sound pickup block at the previous stage (not shown).

On the other hand, with respect to the high frequency components that pass through the high-pass filter (HPF) 62 from among the input signals from the sound pickup block, after the high frequency components are delayed by a predetermined time by the delay circuit 63, the stereophonic sound reproduction signal generation filter 65 performs a filtering process for generating a stereophonic sound reproduction signal. Then, the adder 66 adds together the output of the stereophonic sound reproduction signal generation filter 64 and the output of the stereophonic sound reproduction signal generation filter 65, and outputs the combined output.

Figure 16:
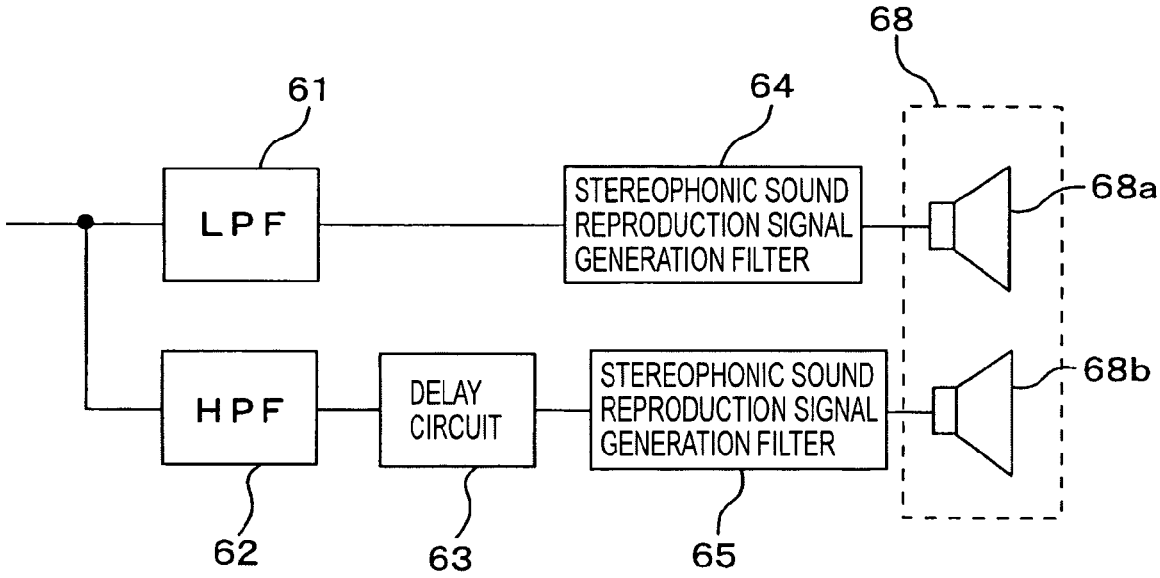
FIG. 16 shows another configuration of the sound apparatus according to this embodiment.

The playback block shown in FIG. 16 does not add the output of the stereophonic sound reproduction signal generation filter 64 and the output of the stereophonic sound reproduction signal generation filter 65, and the reproduction signal of the low frequency components output from the stereophonic sound reproduction signal generation filter 64 is reproduced using a woofer 68*a* of a speaker system 68, the woofer 68*a* playing back the low frequencies. Then, the reproduction signal of the high frequency components output from the stereophonic sound reproduction signal generation filter 65 is reproduced using a tweeter 68*b* of the speaker system 68, the tweeter 68*b* playing back medium to high frequency components.

Therefore, even when the sound apparatus is configured as shown in FIGS. 15 and 16, since only the high frequency components contained in the input signal are delayed by a predetermined time by the delay circuit 63, only the low frequency components of the input signal can be reproduced earlier. As a result, it becomes possible for the listener in a reproduction sound image to perceive the sensation of sound localization by the reproduction sound of the low frequency components that arrive earlier.

Figure 17:
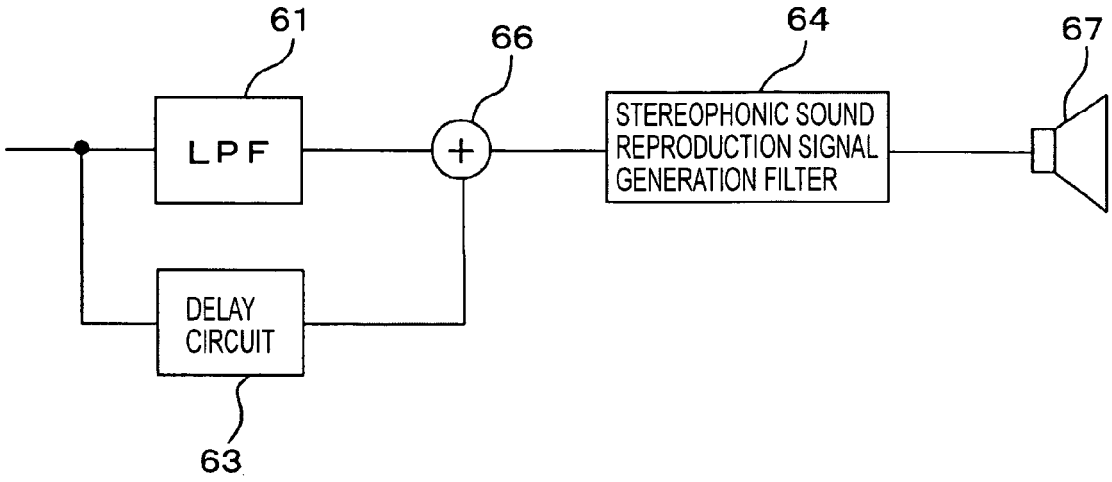
FIG. 17 shows another configuration of the sound apparatus according to this embodiment.

In the playback block shown in FIG. 17, the adder 66 adds together the low frequency component signal that pass through the low-pass filter (LPF) 61 from among the input signals and the signal such that the input signal is delayed by a predetermined time by the delay circuit 63. Then, the added output of the adder 66 is supplied to the speaker 67 through the stereophonic sound reproduction signal generation filter 64.

Figure 18:
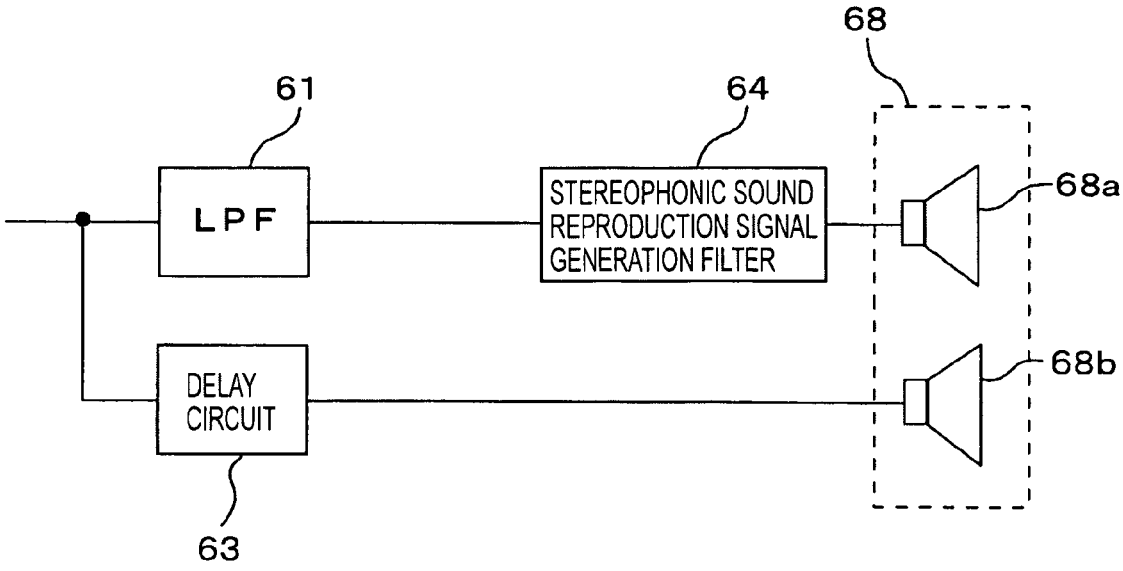
FIG. 18 shows another configuration of the sound apparatus according to this embodiment.

In the playback block shown in FIG. 18, the low frequency component signal output from the LPF 61 is reproduced by the woofer 68*a* of the speaker system 68 through the stereophonic sound reproduction signal generation filter 64, and the output of the delay circuit 63 is reproduced by the tweeter 68*b* of the speaker system 68.

When the sound apparatus is configured as shown in FIGS. 17 and 18, only the low frequency components of the input signal can be reproduced earlier. As a result, it becomes possible to enable the listener in the reproduction sound field to perceive the sensation of sound localization by the reproduction sound of the low frequency components that arrive earlier.

A description will now be given below of an example of the configuration in which the sound apparatus according to this embodiment described up to this point is applied to an AV system. First, an example of the data structure of a recording medium used as a sound source in the AV system is described.

Figure 21:
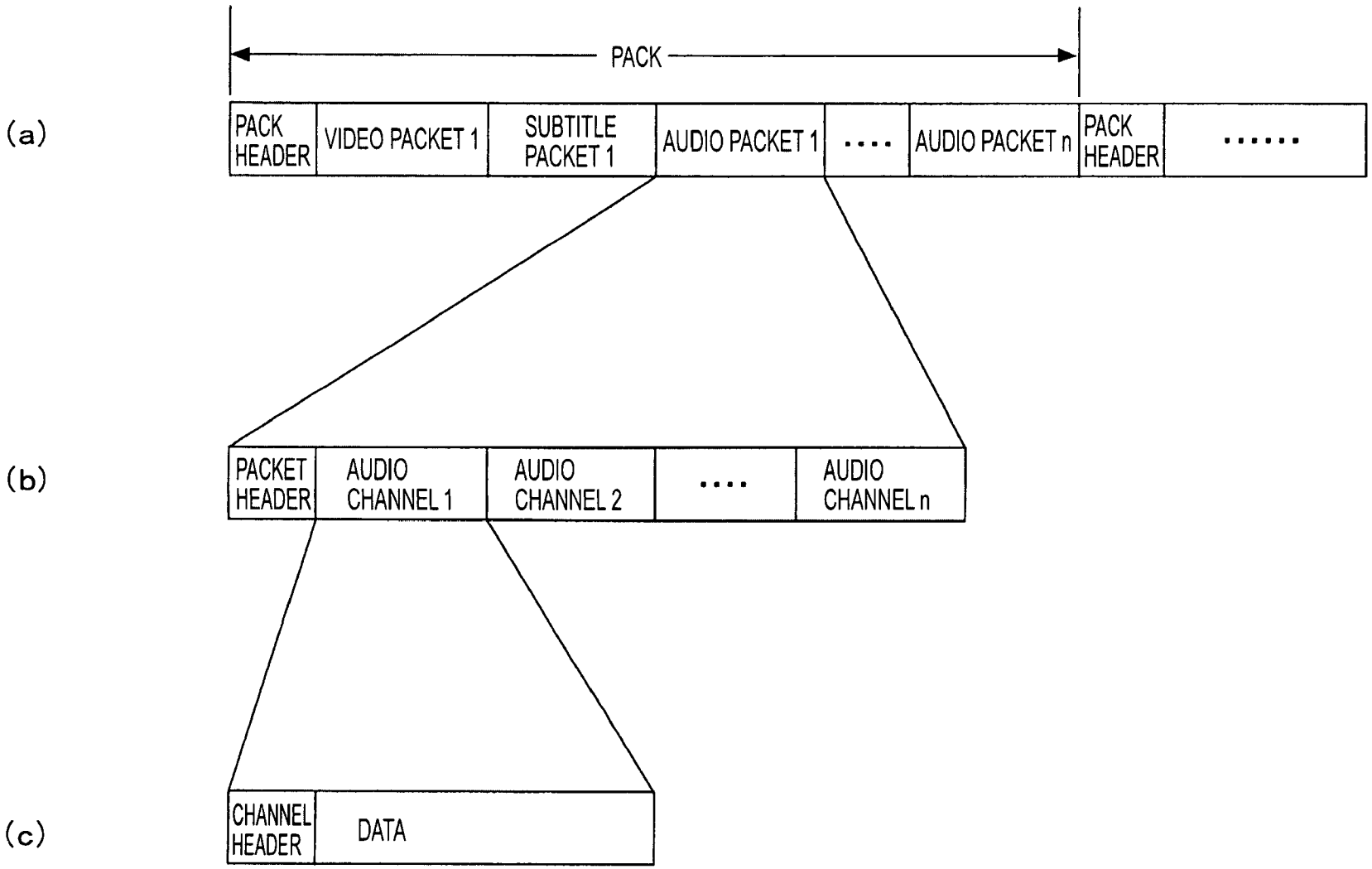
FIG. 21 shows an example of the structure of multiplexed data from a sound source.

FIG. 21 is a schematic view showing an example of data structure of a recording medium in that case.

In the recording medium shown in part (a) of FIG. 21, packs composed of, for example, a video packet, a subtitle packet, a plurality of audio packet 1, audio packet 2, . . . audio packet n are formed. A pack header is attached to the beginning thereof. In the pack header, for example, additional information serving as a reference during synchronous playback is given.

As shown in part (b) of FIG. 21, the audio packet is composed of a plurality of audio channel 1, audio channel 2, . . . audio channel n, and a packet header is attached to the beginning thereof. In the packet header, for example, various kinds of control data used for audio control are recorded. For example, a sampling frequency, the number of multiplexing channels, a crossover frequency, a data coding method code indicating a data coding method, an audio signal specification code indicating the specification (format) of an audio signal playback method, etc., are recorded.

In each audio channel, as shown in part (c) of FIG. 21, a channel header is attached to the beginning of the data. In the channel header, for example, pieces of data indicating a channel number, a frequency band, a gain, and the amount of phase are recorded as additional information.

Here, a description is given of an example of the configuration of an AV system capable of playing back the above-described optical disc.

Figure 19:
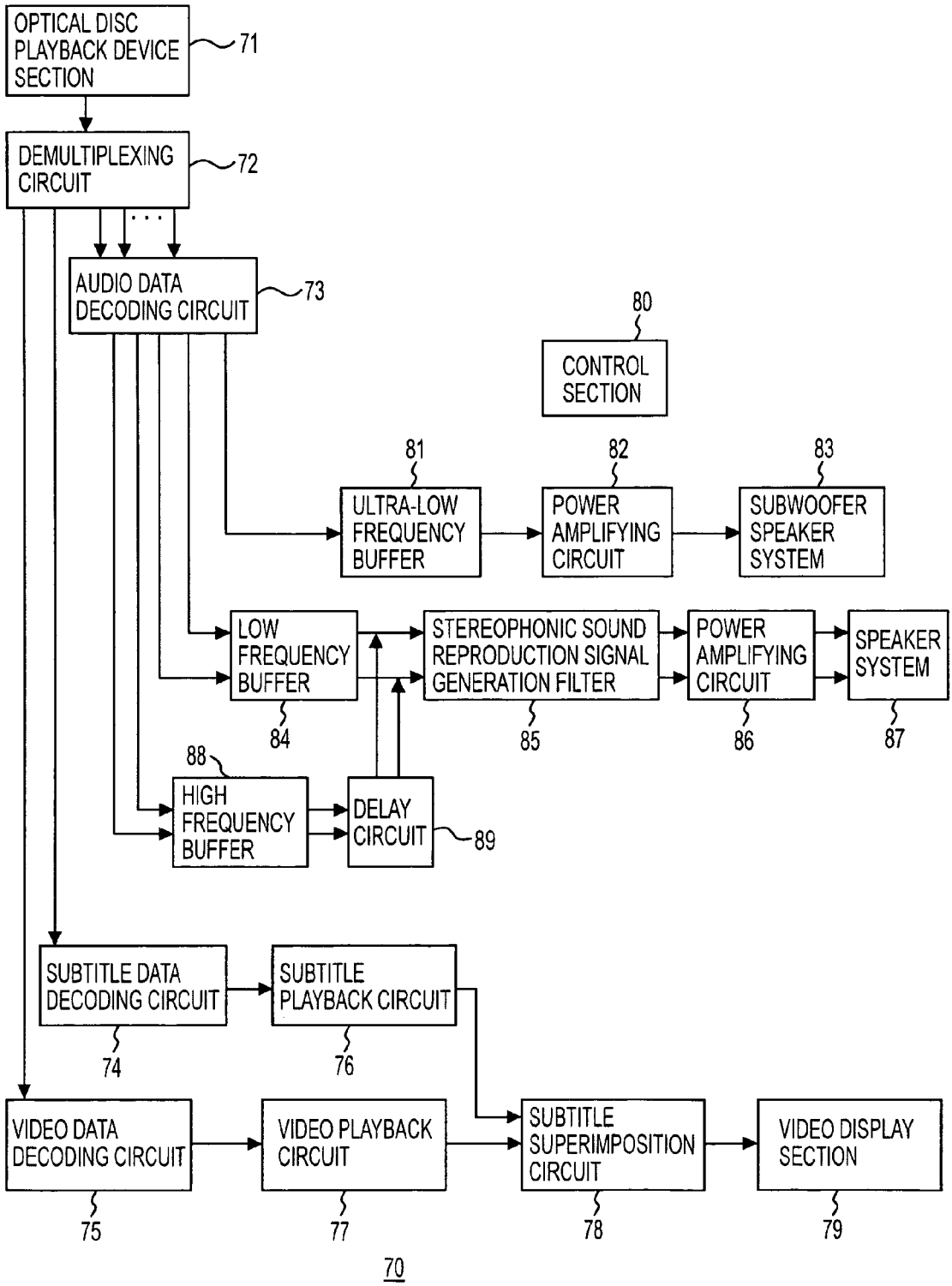
FIG. 19 is a block diagram showing the configuration of an AV system.

FIG. 19 is a block diagram showing the configuration of the above-described AV system. It is assumed in this case that video data and subtitle data are multiplexed with audio data on the recording medium. Furthermore, it is assumed in this case that, as audio data to be recorded on recording medium, audio data is recorded such that a signal picked up by the above-described dummy head microphone is separated into low frequency components and high frequency components, the high frequency components are delayed, and these components are multiplexed.

In FIG. 19, an optical disc playback section 71 reads multiplexed data recorded on an optical disc. A demultiplexing circuit 72 detects and separates the header, the video data, the subtitle data, and the audio data of a plurality of channels from the read multiplexed data.

An audio data decoding circuit 73 decodes the audio data transmitted from the demultiplexing circuit 72. At this time, the audio data decoding circuit 73 outputs the ultra-low frequency data among the decoded audio data to an ultra-low frequency buffer circuit 81 and outputs the low frequency data to a low frequency buffer circuit 84. Furthermore, the audio data decoding circuit 73 outputs the high frequency data to a high frequency buffer circuit 88.

The ultra-low frequency buffer circuit 81 converts the input ultra-low frequency data into an analog ultra-low frequency signal, and outputs the signal. The low frequency buffer circuit 84 converts the input low frequency data into an analog low frequency signal, and outputs the signal. The high-frequency buffer circuit 88 converts the input high frequency data into an analog high frequency signal, and outputs the signal.

A power amplifying circuit 82 amplifies the ultra-low frequency signal from the ultra-low frequency buffer circuit 81 to a predetermined level, and thereafter outputs the signal to a subwoofer speaker system 83, whereby the signal is output. A delay circuit 89 delays the high frequency signal from the high-frequency buffer circuit 88 by a predetermined time and outputs the signal.

A stereophonic sound reproduction signal generation filter 85 combines the low frequency signal input from the low frequency buffer circuit 84 and the high frequency signal delayed by a predetermined time by the delay circuit 89, thereafter performs a stereophonic sound reproduction signal generation process on the signals, and outputs them to a power amplifying circuit 86. In the power amplifying circuit 86, after the audio signal from the stereophonic sound reproduction signal generation filter 85 is amplified to a predetermined level, the signal is output to a speaker system 87, whereby the signal is output.

A subtitle data decoding circuit 74 decodes subtitle data from a subtitle packet in accordance with timing information contained in the header information transmitted from the demultiplexing circuit 72, and outputs the subtitle data. Similarly to that described above, a video data decoding circuit 75 decodes the video data in accordance with the frame rate contained in the header information transmitted from the demultiplexing circuit 72, and outputs the data.

A subtitle playback circuit 76 performs a predetermined playback process on the subtitle data decoded by the subtitle data decoding circuit 74, and outputs the data as a subtitle signal. A video playback circuit 77 performs a predetermined playback process on the video data decoded by the video data decoding circuit 75, and outputs the data as a video signal.

A subtitle/superimposition circuit 78 performs a so-called superimposition process of superimposing a subtitle signal onto a video signal in accordance with timing information, such as subtitle control information, recorded as the header information in the packet header attached to the subtitle packet, converts the signal into a video signal format in compliance with a video display section 79, and outputs the signal. A video display section 79 displays a video image on the basis of the video signal supplied from the subtitle/superimposition circuit 78.

A control section 80 controls the entire AV system 70 and performs various kinds of control by using the header information demultiplexed from the multiplexed data in the demultiplexing circuit 72. For example, switching control for switching the operation of the audio data decoding circuit 73 is performed in accordance with the sampling frequency and the data coding method code attached to the packet header shown in FIG. 20.

Furthermore, only the audio packet matching the specification of the audio reproduction system is selected from the audio signal specification (format) code attached to the packet header in a similar manner. For example, if the audio packet 1 is an audio packet of a binaural system, the audio packet being picked up by the sound apparatus according to this embodiment, and the audio packet 2 is an audio packet of a surround playback system, the audio packet 1 is selected.

The embodiment has been discussed above by assuming that, in the AV system 70 shown in FIG. 19, audio data that is separated into ultra-low frequency components, low frequency components, and high frequency components is recorded on a recording medium, such as an optical disc. However, this is only an example, and, for example, audio data that is not subjected to band division may also be multiplexed and recorded on a recording medium.

Figure 20:
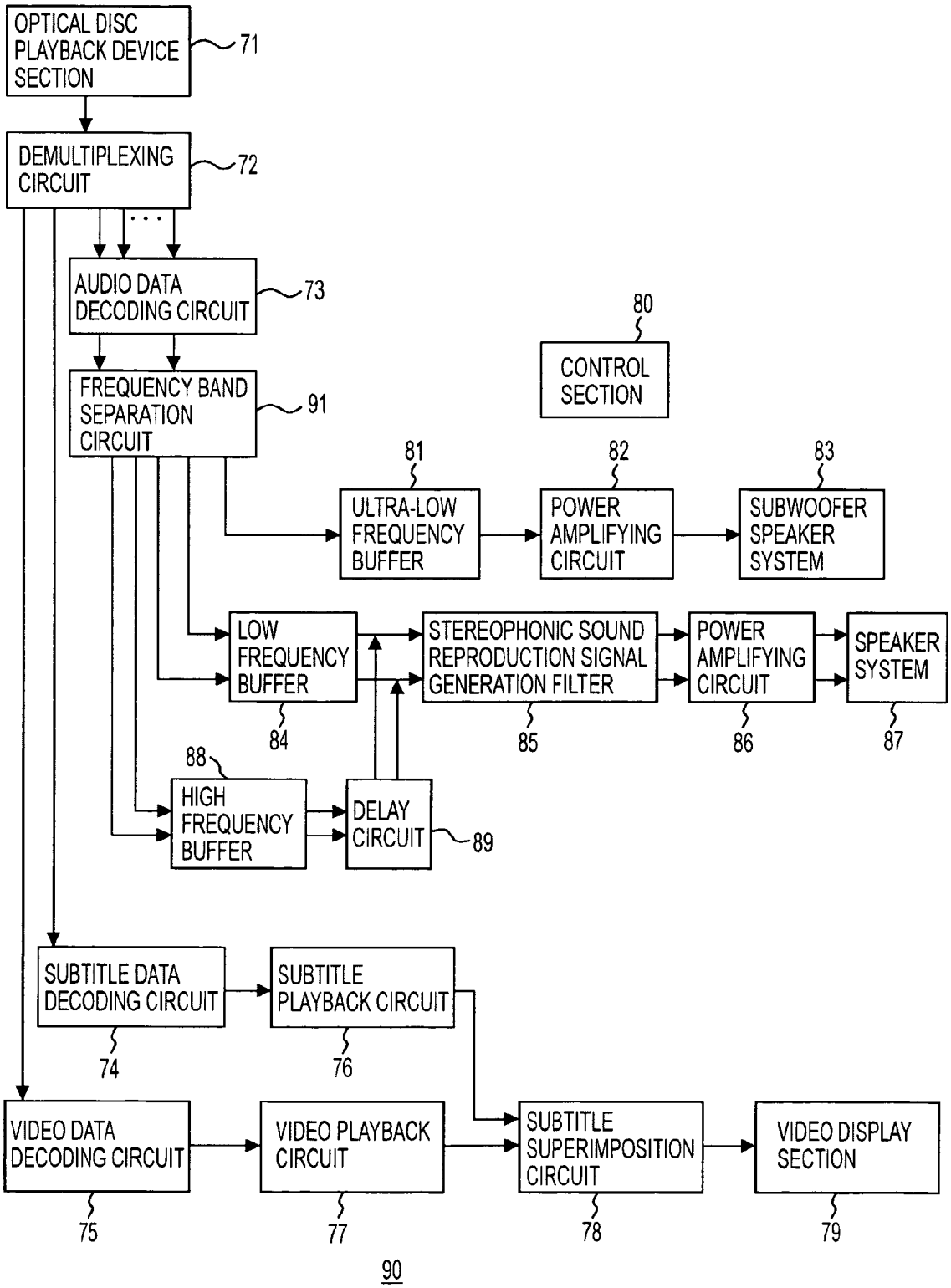
FIG. 20 is a block diagram showing another configuration of the AV system.

The block configuration of the AV system in that case is shown in FIG. 20. Blocks in FIG. 20, which are identical to the blocks shown in FIG. 19, are designated with the same reference numerals, and accordingly, detailed descriptions thereof are omitted.

An AV system 90 shown in FIG. 20 differs from the AV system 70 shown in FIG. 19 in that, as shown in FIG. 20, a frequency band separation circuit 91 is provided between the audio data decoding circuit 73 and the buffer circuits 81, 84, and 88.

In such a frequency band separation circuit 91, the audio data that is read from the optical disc and that is decoded by the audio data decoding circuit 73 is separated into ultra-low frequency data, high frequency data, and low frequency data. The ultra-low frequency data that is separated by the frequency band separation circuit 91 in this manner is supplied to the ultra-low frequency buffer circuit 81, the low frequency data is supplied to the low frequency buffer circuit 84, and the high frequency data is supplied to the high-frequency buffer circuit 88.

Therefore, also, when sound signals recorded on a recording medium are played back by such AV systems 70 and 90, it is possible to enable the listener U to perceive the target sensation of sound localization even when the stereophonic sound characteristics of the stereophonic sound reproduction signal generation filter 85 are set using the standard head-related transfer function.

The embodiment has been discussed above by assuming that, in such an AV system, various kinds of data to be played back, in which video data, subtitle data, and audio data of a plurality of audio channels are multiplexed, is recorded on a recording medium, such as an optical disc. However, the AV system can also be configured in such a way that data to be played back, such as video data, subtitle data, and audio data of a plurality of audio channels, is received, for example, via a network.

In such an AV system, a subwoofer playback system for playing back ultra-low frequency components is provided. However, such a subwoofer playback system needs not to be provided.

What is claimed is:

1. An apparatus for reproducing stereophonic sound to a listener facing a listening direction, using at least one speaker, the apparatus comprising:

a memory storing a plurality of transfer functions defining propagation characteristics of sound propagating between the speakers and listening positions;

a filter for separating low frequency components from a binaural sound pickup signal at a filter frequency;

means for delaying high frequency components of the binaural sound pickup signal relative to the separated low frequency components by a delay time; and a stereophonic sound signal generation processor for:

selecting, from the memory, at least one of the transfer functions based on an angle between the listening direction and a direction to one of the speakers; and generating, based on the selected at least one transfer function, a stereophonic sound reproduction signal by processing the separated low frequency components and the delayed high frequency components, wherein the delay time reduces echo between the high frequency components and the low frequency components and causes a perceived sound image position of the sound perceived by the listener to match a physical position of the at least one speaker.

2. The apparatus according to claim 1, further comprising:

means for combining the separated low frequency components with the delayed high frequency components, wherein the stereophonic sound signal generation processor generates the stereophonic sound reproduction signal by processing the combined low and high frequency components.

3. The apparatus according to claim 1, wherein the at least one speaker includes a first speaker for reproducing a low tone range and a second speaker for reproducing a high tone range, the first speaker reproduces the stereophonic sound reproduction signal, and the second speaker reproduces the delayed high frequency components.

4. The apparatus according to claim 1, wherein the binaural sound pickup signal is generated by a dummy head pickup microphone.

5. The apparatus according to claim 1, wherein the binaural sound pickup signal is generated by a microphone mounted on a human being.

6. The apparatus according to claim 1, wherein the binaural sound pickup signal is generated by combining a head transfer function with a sound source signal.

7. The sound reproduction apparatus according to claim 1, wherein the filter further separates the high frequency components from the binaural sound pickup signal.

8. An apparatus for reproducing a stereophonic sound to a listener facing a listening direction, using at least one speaker, the apparatus comprising:

a memory storing a plurality of transfer functions defining propagation characteristics of sound propagating between the speakers and listening positions;

a filter for separating low frequency components from an input signal at a filter frequency;

means for delaying high frequency components of the input signal relative to the separated low frequency components by a delay time; and a stereophonic sound signal generation processor for:

selecting, from the memory, at least one of the transfer functions based on an angle between the listening direction and a direction to one of the speakers; and generating, based on the selected transfer function, a stereophonic sound reproduction signal by processing the separated low frequency components, wherein the delay time reduces echo between the high frequency components and the low frequency components and causes a perceived sound image position of the sound perceived by the listener to match a physical position of the at least one speaker.

9. The apparatus according to claim 8, wherein the filter further separates the high frequency components from the input signal.

10. A method for reproducing a stereophonic sound to a listener facing a listening direction, using speakers, the method comprising:

storing a plurality of transfer functions defining propagation characteristics of sound propagating between the speakers and listening positions;

filtering an input signal to separate low frequency components from the input signal at a filter frequency;

delaying high frequency components of the input signal relative to the separated low frequency components by a delay time;

selecting at least one of the transfer functions based on an angle between the listening direction and a direction to one of the speakers;

reproducing, based on the selected transfer function, a stereophonic sound signal at the listening position by processing the separated low frequency components and the delayed high frequency components; and reproducing the stereophonic sound signal with the speakers, wherein the delay time reduces echo between the high frequency components and the low frequency components and causes a perceived sound image position of the sound perceived by the listener to match a physical position of the speakers.

11. The method according to claim 10, wherein the input signal is a binaural sound pickup signal.

12. The apparatus according to claim 1, wherein the filter frequency is between about 1 kHz and 3 kHz.

13. The apparatus according to claim 8, wherein the filter frequency is between about 1 kHz and 3 kHz.

14. The method of claim 10, wherein the filter frequency is between about 1 kHz and 3 kHz.

* * * * *